US010618271B2

(12) United States Patent
Kamoda et al.

(10) Patent No.: US 10,618,271 B2
(45) Date of Patent: Apr. 14, 2020

(54) NUMBER PRINTING APPARATUS

(71) Applicant: KOMORI CORPORATION, Tokyo (JP)

(72) Inventors: Hiroyoshi Kamoda, Tsukuba (JP); Hiromitsu Numauchi, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 315 days.

(21) Appl. No.: 15/570,782

(22) PCT Filed: Apr. 28, 2016

(86) PCT No.: PCT/JP2016/063309
§ 371 (c)(1),
(2) Date: Oct. 31, 2017

(87) PCT Pub. No.: WO2016/178405
PCT Pub. Date: Nov. 10, 2016

(65) Prior Publication Data

US 2018/0117901 A1 May 3, 2018

(30) Foreign Application Priority Data

May 1, 2015 (JP) ..... 2015-093806

(51) Int. Cl.
*B41F 13/00* (2006.01)
*B41F 33/08* (2006.01)
(Continued)

(52) U.S. Cl.
CPC ..... *B41F 13/0032* (2013.01); *B41F 11/02* (2013.01); *B41F 13/34* (2013.01);
(Continued)

(58) Field of Classification Search
CPC ..... B41F 13/0032
(Continued)

(56) References Cited

U.S. PATENT DOCUMENTS 4,448,121 A * 5/1984 Uno ..... B41F 33/0036 101/2
8,039,826 B2 * 10/2011 Pearson ..... B41F 33/0081 250/559.39
(Continued)

FOREIGN PATENT DOCUMENTS

EP 2 614 957 A1 7/2013
JP 2000-62134 A 2/2000
(Continued)

OTHER PUBLICATIONS

Office Action dated Mar. 4, 2019 in corresponding Chinese Application No. 201680025121.9.
(Continued)

*Primary Examiner* — Anthony H Nguyen
(74) *Attorney, Agent, or Firm* — Birch, Stewart, Kolasch & Birch, LLP.

(57) ABSTRACT

In order to provide a numbering and imprinting machine capable of minimizing the amount of wasted paper produced, the numbering and imprinting machine is provided with: a first-number inspection camera (124B) that is arranged downstream of the position of contact between an impression cylinder (112) and a first-number cylinder (113) of a first-number printing unit (111) in the direction of rotation of the impression cylinder (112), and images a first number printed on paper (W) held on the impression cylinder (112); a second number inspection camera (124C) that is arranged downstream of the position of contact between an impression cylinder (117) and a second-number cylinder (118) of a second-number printing unit (116) in the direction of rotation of the impression cylinder (117), and images a second number printed on paper (W) held on the impression cylinder (117); and a printing-press control device (10) that controls first- and second-number-cylinder throw-on and throw-off devices (38, 39) based on signals from the first-
(Continued)

and second-number inspection cameras (124B, 124C) to cause the first-number cylinder (113) and the second-number cylinder (118) to make separating movements.

6 Claims, 25 Drawing Sheets

(51) Int. Cl.

| | |
|---|---|
| ***B41F 19/00*** | (2006.01) |
| ***B41F 11/02*** | (2006.01) |
| ***B41F 33/02*** | (2006.01) |
| ***B41F 33/04*** | (2006.01) |
| ***B41F 33/00*** | (2006.01) |
| ***B41F 17/00*** | (2006.01) |
| ***B41F 33/06*** | (2006.01) |
| ***B41F 13/34*** | (2006.01) |
| ***B41J 2/01*** | (2006.01) |
| ***B41J 29/393*** | (2006.01) |

(52) U.S. Cl.
CPC ..... *B41F 17/008* (2013.01); *B41F 19/00* (2013.01); *B41F 19/001* (2013.01); *B41F 19/007* (2013.01); *B41F 33/0036* (2013.01); *B41F 33/02* (2013.01); *B41F 33/025* (2013.01); *B41F 33/045* (2013.01); *B41F 33/06* (2013.01); *B41F 33/08* (2013.01); *B41J 2/01* (2013.01); *B41J 29/393* (2013.01)

(58) Field of Classification Search
USPC ..... 101/76
See application file for complete search history.

(56) References Cited

U.S. PATENT DOCUMENTS

| | | | | |
|---|---|---|---|---|
| 2009/0188405 | A1* | 7/2009 | Stiel | B41F 17/00 101/484 |
| 2013/0061770 | A1* | 3/2013 | Izawa | B41J 13/223 101/483 |
| 2013/0139709 | A1* | 6/2013 | Kanayama | B41F 13/0032 101/76 |
| 2013/0312625 | A1* | 11/2013 | Kamoda | B41F 11/02 101/153 |
| 2015/0283800 | A1 | 10/2015 | Kamoda | |

FOREIGN PATENT DOCUMENTS

| | | | |
|---|---|---|---|
| JP | 2014-19148 | A | 2/2014 |
| JP | 2015-85647 | A | 5/2015 |
| WO | WO 2014/065108 | A1 | 5/2014 |

OTHER PUBLICATIONS

Extended European Search Report dated Oct. 10, 2018 issued in corresponding EP Application No. 16789541.6.
Chinese Office Action for Chinese Application No. 201680025121.9, dated Nov. 1, 2019, with English translation.

* cited by examiner

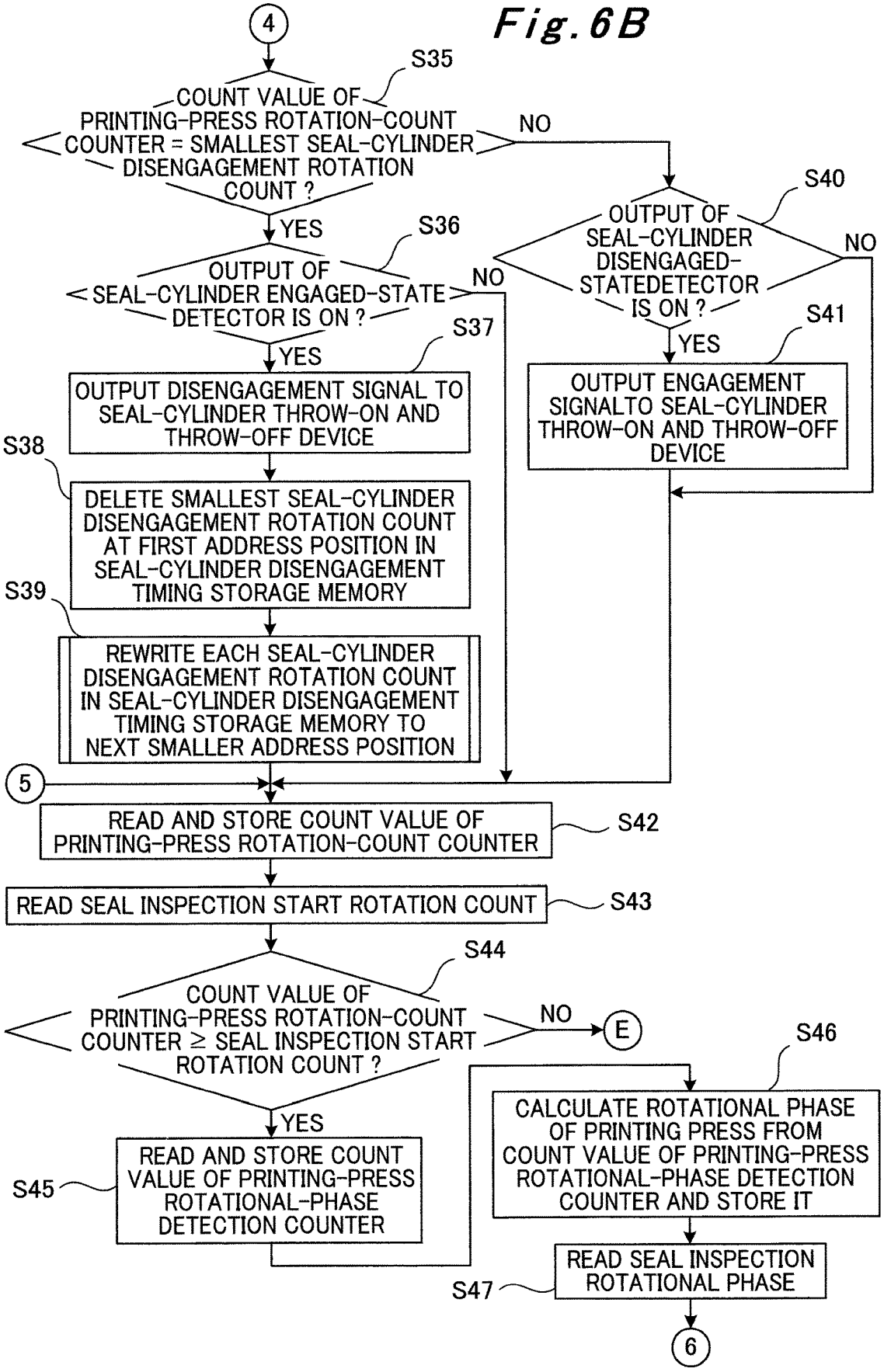
Fig. 6B
4
S35
COUNT VALUE OF PRINTING-PRESS ROTATION-COUNT COUNTER = SMALLEST SEAL-CYLINDER DISENGAGEMENT ROTATION COUNT ?
NO
YES
S36
OUTPUT OF SEAL-CYLINDER ENGAGED-STATE DETECTOR IS ON ?
NO
YES
S37
OUTPUT DISENGAGEMENT SIGNAL TO SEAL-CYLINDER THROW-ON AND THROW-OFF DEVICE
S38
DELETE SMALLEST SEAL-CYLINDER DISENGAGEMENT ROTATION COUNT AT FIRST ADDRESS POSITION IN SEAL-CYLINDER DISENGAGEMENT TIMING STORAGE MEMORY
S39
REWRITE EACH SEAL-CYLINDER DISENGAGEMENT ROTATION COUNT IN SEAL-CYLINDER DISENGAGEMENT TIMING STORAGE MEMORY TO NEXT SMALLER ADDRESS POSITION
S40
OUTPUT OF SEAL-CYLINDER DISENGAGED-STATEDETECTOR IS ON ?
NO
YES
S41
OUTPUT ENGAGEMENT SIGNALTO SEAL-CYLINDER THROW-ON AND THROW-OFF DEVICE
5
S42
READ AND STORE COUNT VALUE OF PRINTING-PRESS ROTATION-COUNT COUNTER
S43
READ SEAL INSPECTION START ROTATION COUNT
S44
COUNT VALUE OF PRINTING-PRESS ROTATION-COUNT COUNTER ≥ SEAL INSPECTION START ROTATION COUNT ?
NO
E
YES
S45
READ AND STORE COUNT VALUE OF PRINTING-PRESS ROTATIONAL-PHASE DETECTION COUNTER
S46
CALCULATE ROTATIONAL PHASE OF PRINTING PRESS FROM COUNT VALUE OF PRINTING-PRESS ROTATIONAL-PHASE DETECTION COUNTER AND STORE IT
S47
READ SEAL INSPECTION ROTATIONAL PHASE
6

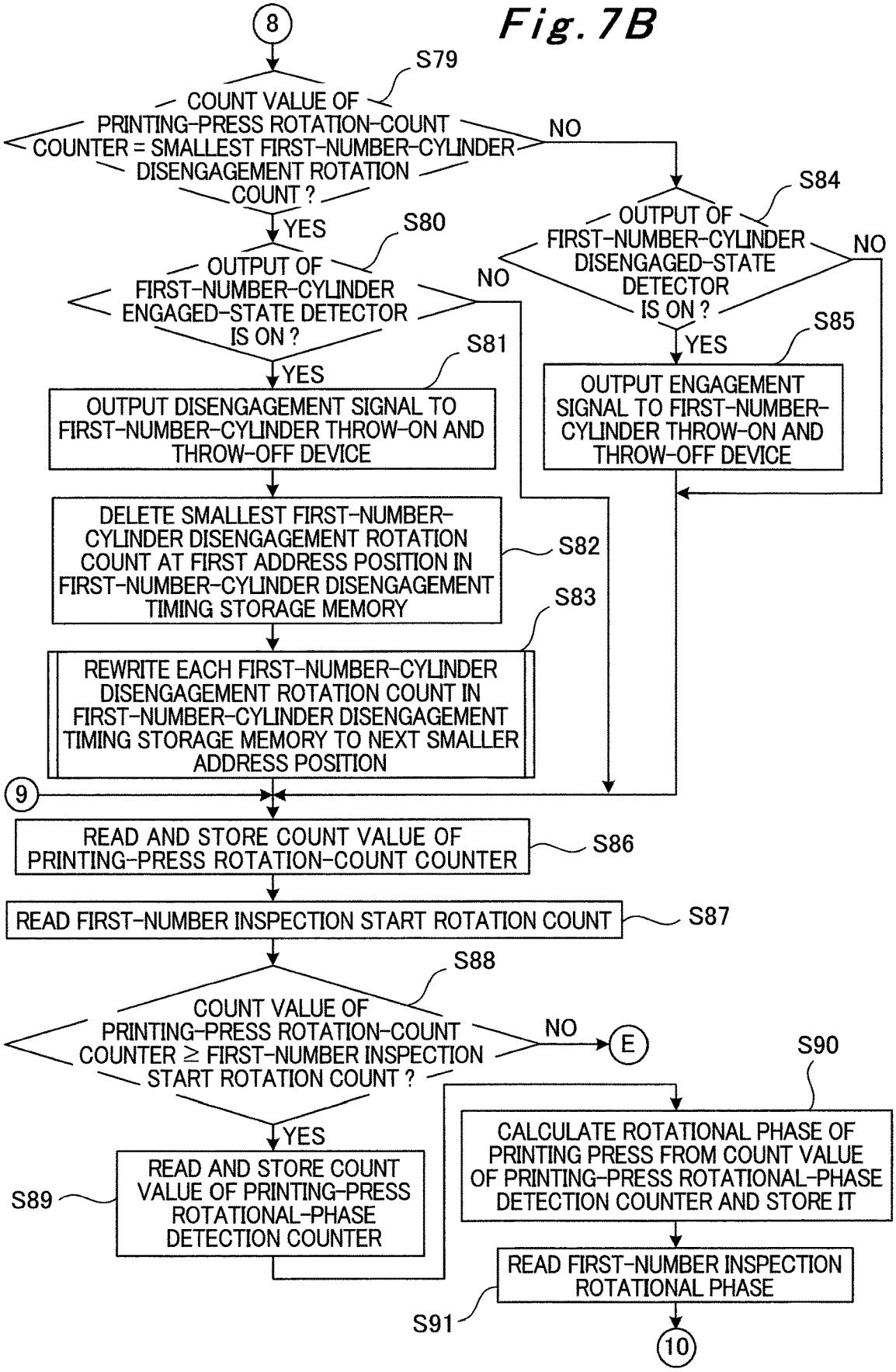
Fig. 7B
8
S79
COUNT VALUE OF PRINTING-PRESS ROTATION-COUNT COUNTER = SMALLEST FIRST-NUMBER-CYLINDER DISENGAGEMENT ROTATION COUNT ?
NO
YES
S80
OUTPUT OF FIRST-NUMBER-CYLINDER ENGAGED-STATE DETECTOR IS ON ?
NO
YES
S81
OUTPUT DISENGAGEMENT SIGNAL TO FIRST-NUMBER-CYLINDER THROW-ON AND THROW-OFF DEVICE
DELETE SMALLEST FIRST-NUMBER-CYLINDER DISENGAGEMENT ROTATION COUNT AT FIRST ADDRESS POSITION IN FIRST-NUMBER-CYLINDER DISENGAGEMENT TIMING STORAGE MEMORY
S82
S83
REWRITE EACH FIRST-NUMBER-CYLINDER DISENGAGEMENT ROTATION COUNT IN FIRST-NUMBER-CYLINDER DISENGAGEMENT TIMING STORAGE MEMORY TO NEXT SMALLER ADDRESS POSITION
S84
OUTPUT OF FIRST-NUMBER-CYLINDER DISENGAGED-STATE DETECTOR IS ON ?
NO
YES
S85
OUTPUT ENGAGEMENT SIGNAL TO FIRST-NUMBER-CYLINDER THROW-ON AND THROW-OFF DEVICE
9
READ AND STORE COUNT VALUE OF PRINTING-PRESS ROTATION-COUNT COUNTER
S86
READ FIRST-NUMBER INSPECTION START ROTATION COUNT
S87
S88
COUNT VALUE OF PRINTING-PRESS ROTATION-COUNT COUNTER ≥ FIRST-NUMBER INSPECTION START ROTATION COUNT ?
NO
E
YES
S89
READ AND STORE COUNT VALUE OF PRINTING-PRESS ROTATIONAL-PHASE DETECTION COUNTER
S90
CALCULATE ROTATIONAL PHASE OF PRINTING PRESS FROM COUNT VALUE OF PRINTING-PRESS ROTATIONAL-PHASE DETECTION COUNTER AND STORE IT
READ FIRST-NUMBER INSPECTION ROTATIONAL PHASE
S91
10

NUMBER PRINTING APPARATUS

TECHNICAL FIELD

The present invention relates to a numbering and imprinting machine for performing number printing on securities or the like.

BACKGROUND ART

A numbering and imprinting machine for performing number printing on securities or the like described, for example, in Patent Document 1 listed below has been known. This conventional numbering and imprinting machine is what is called a common impression cylinder type (satellite type), in which a seal cylinder (single cylinder) that prints a seal, a first-number cylinder (single cylinder) that prints a first number, and a second-number cylinder (single cylinder) that prints a second number are in contact with an impression cylinder (double-size cylinder) that holds and transports a sheet, and the seal is printed by the seal cylinder onto a sheet held on the impression cylinder, then the first number is printed by the first-number cylinder, and thereafter the second number is printed by the second-number cylinder.

PRIOR ART DOCUMENT

Patent Document

Patent Document 1: Japanese Patent Application Publication No. 2000-201688

SUMMARY OF THE INVENTION

Problem to be Solved by the Invention

In a common impression cylinder type (satellite type) numbering and imprinting machine as mentioned above, an inspection cylinder (double-size cylinder) may be in contact with the impression cylinder through a transfer cylinder (single cylinder) in the case of inspecting the seal and the numbers printed on a sheet. In this case, a sheet on which the seal printing and the first- and second-number printing have been performed may be passed from the impression cylinder to the inspection cylinder through the transfer cylinder, and the seal on the sheet, held on the inspection cylinder, is inspected with a seal inspection camera while the numbers are inspected with a number inspection camera. If a trouble has occurred in the seal printing or the number printing, the seal cylinder and the number cylinders are separated (disengaged) from the impression cylinder to thereby forcibly end the seal printing and the number printing.

However, in the case of inspecting the seal printing and the number printing in the above manner, if a trouble occurs, for example, in the first-number printing, multiple (five) sheets with a print failure are further produced while the sheet on which the printing failure has occurred is inspected on the inspection cylinder and the printing is forcibly ended. Thus, a lot of wasted paper is produced from expensive sheets used for securities or the like.

In view of this, an object of the present invention is to provide a numbering and imprinting machine capable of minimizing the amount of wasted paper produced.

Means for Solving the Problems

A numbering and imprinting machine according to the present invention to solve the problem above is a numbering and imprinting machine that includes first-number printing means including a first-number impression cylinder that holds and transports a sheet, a first-number cylinder that is arranged to be movable to come into contact with and separate from the first-number impression cylinder and performs first-number printing on a sheet held on the first-number impression cylinder, and ink feeding means for feeding ink to the first-number cylinder, second-number printing means including a second-number impression cylinder that is arranged downstream of the first-number printing means in a sheet transport direction and holds and transports a sheet from the first-number printing means, a second-number cylinder that is arranged to be movable to come into contact with and separate from the second-number impression cylinder and performs second-number printing on a sheet held on the second-number impression cylinder, and ink feeding means for feeding ink to the second-number cylinder, first-number-cylinder contacting-separating-movement means for causing the first-number cylinder to move to come into contact with and separate from the first-number impression cylinder, and second-number-cylinder contacting-separating-movement means for causing the second-number cylinder to move to come into contact with and separate from the second-number impression cylinder, the numbering and imprinting machine characterized in that the numbering and imprinting machine includes:

first-number imaging means that is arranged downstream of a position of contact between the first-number impression cylinder and the first-number cylinder in a direction of rotation of the first-number impression cylinder, for imaging a first number printed on a sheet held on the first-number impression cylinder;

second-number imaging means that is arranged downstream of a position of contact between the second-number impression cylinder and the second-number cylinder in a direction of rotation of the second-number impression cylinder, for imaging a second number printed on a sheet held on the second-number impression cylinder;

number inspecting means for determining whether or not the first number and the second number printed on a sheet are satisfactory based on image signals from the first-number imaging means and the second-number imaging means; and controlling means for controlling the first-number-cylinder contacting-separating-movement means and the second-number-cylinder contacting-separating-movement means based on a dissatisfactory signal from the number inspecting means to cause the first-number cylinder and the second-number cylinder to make separating movements.

In the above-described numbering and imprinting machine, the numbering and imprinting machine according to the present invention is characterized in that the numbering and imprinting machine includes:

seal printing means including a seal impression cylinder that is arranged upstream of the first-number printing means in the sheet transport direction, holds a sheet, and transports the sheet toward the first-number printing means, a seal cylinder that is arranged to be movable to come into contact with and separate from the seal impression cylinder and performs seal printing on a sheet held on the seal impression cylinder, and ink feeding means for feeding ink to the seal cylinder;

seal-cylinder contacting-separating-movement means for causing the seal cylinder to move to come into contact with and separate from the seal impression cylinder;

seal imaging means that is arranged downstream of a position of contact between the seal impression cylinder and the seal cylinder in a direction of rotation of the seal impression cylinder, for imaging a seal printed on a sheet held on the seal impression cylinder; and seal inspecting means for determining whether or not the seal printed on a sheet is satisfactory based on an image signal from the seal imaging means, and the controlling means controls the seal-cylinder contacting-separating-movement means, the first-number-cylinder contacting-separating-movement means, and the second-number-cylinder contacting-separating-movement means based on a dissatisfactory signal from the seal inspecting means or the number inspecting means to cause the seal cylinder, the first-number cylinder, and the second-number cylinder to make separating movements.

In the above-described numbering and imprinting machine, the numbering and imprinting machine according to the present invention is characterized in that the controlling means outputs an emergency separating movement signal for causing the cylinder to make an emergency separating movement to the cylinder contacting-separating-movement means based on a dissatisfactory signal from the inspecting means.

In the above-described numbering and imprinting machine, the numbering and imprinting machine according to the present invention is characterized in that the controlling means controls the cylinder contacting-separating-movement means based on the emergency separating movement signal to cause the cylinder to make an emergency separating movement at an emergency cylinder movement timing different from a normal cylinder movement timing used when a printing operation is ended.

In the above-described numbering and imprinting machine, the numbering and imprinting machine according to the present invention is characterized in that the numbering and imprinting machine further includes:

an inkjet device provided at a delivery unit; and mark imaging means provided at a sheet feeder;

the controlling means controls the inkjet device based on a dissatisfactory signal from the inspecting means to print on a sheet a mark that varies depending on a printing condition, controls the mark imaging means to image the mark printed on the sheet by the inkjet device, and controls the seal-cylinder contacting-separating-movement means and the first-number-cylinder contacting-separating-movement means according to a mark identified based on an image signal from the mark imaging means.

Effect of the Invention

In the numbering and imprinting machine according to the present invention, the first-number imaging means, arranged downstream of the position of contact between the first-number impression cylinder and the first-number cylinder of the first-number printing means in the direction of rotation of the first-number impression cylinder, images the first number printed on a sheet held on the first-number impression cylinder; the second-number imaging means, arranged downstream of the position of contact between the second-number impression cylinder and the second-number cylinder of the second-number printing means in the direction of rotation of the second-number impression cylinder, images the second number printed on a sheet held on the second-number impression cylinder; the controlling means determines whether or not the first number and the second number printed on a sheet are satisfactory based on image signals from the first-number imaging means and the second-number imaging means; and if dissatisfactory, the controlling means controls the first-number-cylinder contacting-separating-movement means and the second-number-cylinder contacting-separating-movement means to cause the first-number cylinder of the first-number printing means and the second-number cylinder of the second-number printing means to make separating movements. In this way, a printing trouble can be found immediately by inspecting the first number and the second number, printed by the first-number printing means and the second-number printing means, immediately after the printing. Further, if a trouble occurs on a sheet, the first- and second-number cylinders are caused to move to separate from the first- and second-number impression cylinders immediately after that to thereby temporarily stop the number printing on the next sheets. Hence, the sheet on which the printing failure has occurred can be the only wasted paper. Accordingly, the amount of wasted paper produced can be minimized.

BRIEF DESCRIPTION OF THE DRAWINGS

FIG. 6B is a flowchart illustrating the operation of the printing-press control device according to the embodiment of the present invention.

FIG. 7B is a flowchart illustrating the operation of the printing-press control device according to the embodiment of the present invention.

MODE FOR CARRYING OUT THE INVENTION

An embodiment of a numbering and imprinting machine according to the present invention will be described based on the drawings. However, the present invention is not limited only to the following embodiment to be described based on the drawings.

<Main Embodiment>

A main embodiment of a printing press combining a numbering and imprinting machine according to the present invention and a coating machine will be described based on FIG. 1 to FIG. 11.

Figure 1:
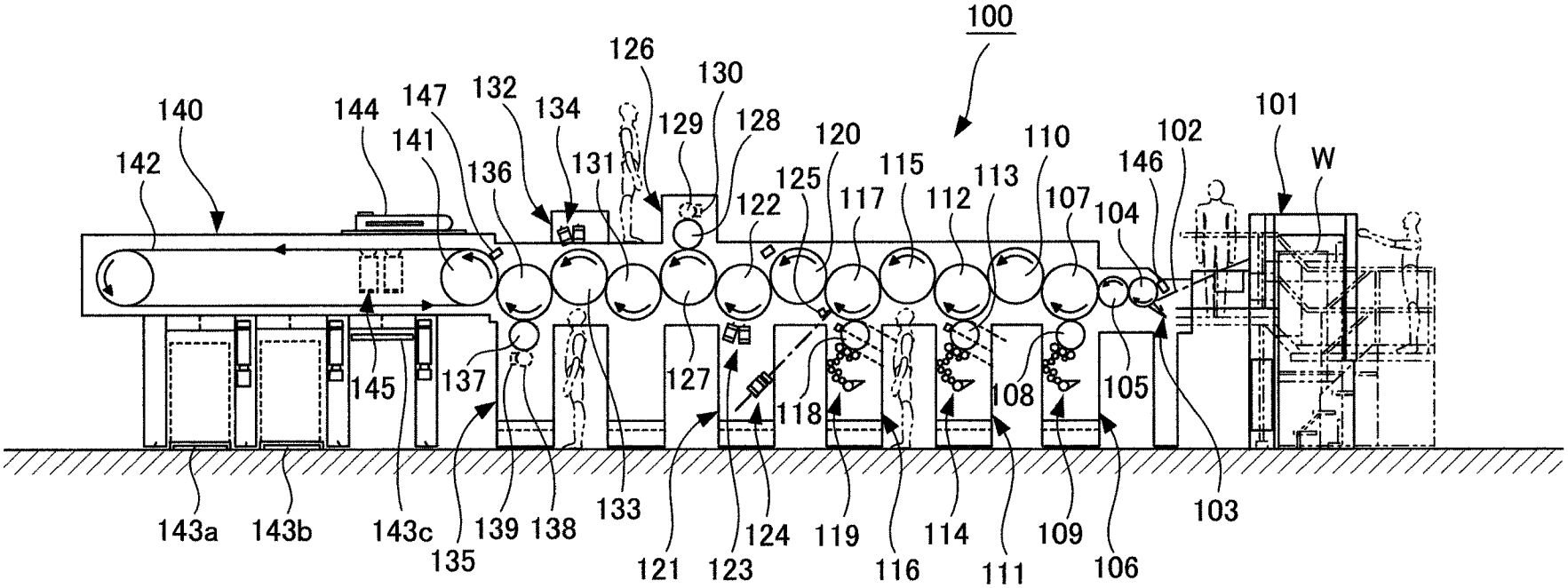
FIG. 1 is a schematic overall configuration view of a main embodiment of a combined printing press combining a numbering and imprinting machine and a coating machine according to the present invention.

As illustrated in FIG. 1, on the leading end side of a feeder board 102 of a sheet feeder 101 that individually feeds printing sheets W, which are sheets, a transfer cylinder 104 that transports a printing sheet W while gripping its leading edge with a gripper device (not illustrated) is disposed through a swing arm shaft pregripper 103. A transfer cylinder 105 that transports a printing sheet W while gripping its leading edge with a gripper device (not illustrated) is in contact with this transfer cylinder 104. The swing arm shaft pregripper 103 can individually pass printing sheets W from the feeder board 102 to the transfer cylinder 105 through the transfer cylinder 104. In this embodiment, components such as these sheet feeder 101, feeder board 102, swing arm shaft pregripper 103, and transfer cylinders 104, 105 constitute sheet feeding means.

An impression cylinder 107, which is a double-size cylinder, is in contact with the transfer cylinder 105, the impression cylinder 107 being a seal impression cylinder that is situated downstream of the contacting portion of the transfer cylinder 105 with the transfer cylinder 104 in the direction of rotation and that transports a printing sheet W while gripping its leading edge with a gripper device (not illustrated). A seal cylinder 108 is in contact with a lower portion of this impression cylinder 107, the seal cylinder 108 being a single cylinder (single-size cylinder) that performs seal printing on a printing sheet W held on the impression cylinder 107. This seal cylinder 108 is supported to be movable to come into contact (engage) with and separate (disengage) from the impression cylinder 107. On the lower side of this seal cylinder 108 is provided an inking device 109 being ink feeding means for feeding ink to the seal cylinder 108. In this embodiment, components such as these impression cylinder 107, seal cylinder 108, and inking device 109 constitute a seal printing unit 106 being seal printing means.

A transport cylinder 110 is in contact with the impression cylinder 107, the transport cylinder 110 being a cylinder that is situated downstream of the contacting portion of the impression cylinder 107 with the seal cylinder 108 (seal printing position) in the direction of rotation and that transports a printing sheet W while gripping its leading edge with a gripper device (not illustrated). An impression cylinder 112 being a double-size cylinder is in contact with this transport cylinder 110, the impression cylinder 112 being a first-number impression cylinder that is situated downstream of the contacting portion of the transport cylinder 110 with the impression cylinder 107 in the sheet transport direction and that transports a printing sheet W while gripping its leading edge with a gripper device (not illustrated). A first-number cylinder 113 being a first-number cylinder is in contact with a lower portion of this impression cylinder 112, the first-number cylinder 113 being a single cylinder (single-size cylinder) that performs first-number printing on a printing sheet W held on the impression cylinder 112. This first-number cylinder 113 is supported to be movable to come into contact (engage) with and separate (disengage) from the impression cylinder 112. On the lower side of this first-number cylinder 113 is provided an inking device 114 being ink feeding means for feeding ink to the first-number cylinder 113. In this embodiment, components such as these impression cylinder 112, first-number cylinder 113, and inking device 114 constitute a first-number printing unit 111 being first-number printing means.

A transport cylinder 115 is in contact with the impression cylinder 112, the transport cylinder 115 being a cylinder that is situated downstream of the contacting portion of the impression cylinder 112 with the first-number cylinder 113 (first-number printing position) in the direction of rotation and that transports a printing sheet W while gripping its leading edge with a gripper device (not illustrated). An impression cylinder 117 being a double-size cylinder is in contact with this transport cylinder 115, the impression cylinder 112 being a second-number impression cylinder that is situated downstream of the contacting portion of the transport cylinder 115 with the impression cylinder 112 in the sheet transport direction and that transports a printing sheet W while gripping its leading edge with a gripper device (not illustrated). A second-number cylinder 118 being a second-number cylinder is in contact with a lower portion of this impression cylinder 117, the second-number cylinder 118 being a single cylinder (single-size cylinder) that performs second-number printing on a printing sheet W held on the impression cylinder 117. This second-number cylinder 118 is supported to be movable to come into contact (engage) with and separate (disengage) from the impression cylinder 117. On the lower side of this second-number cylinder 118 is provided an inking device 119 being ink feeding means for feeding ink to the number cylinder 118. In this embodiment, components such as these impression cylinder 117, second-number cylinder 118, and inking device 119 constitute a second-number printing unit 116 being second-number printing means.

A transport cylinder 120 is in contact with the impression cylinder 117, the transport cylinder 120 being a cylinder that is situated downstream of the contacting portion of the impression cylinder 117 with the second-number cylinder 118 (second-number printing position) in the direction of rotation and that transports a printing sheet W while gripping its leading edge with a gripper device (not illustrated). An impression cylinder 122 is in contact with this transport cylinder 120, the impression cylinder 122 being a cylinder that is situated downstream of the position of contact of the transport cylinder 120 with the impression cylinder 117 in the sheet transport direction and that transports a printing sheet W while gripping its leading edge with a gripper device (not illustrated). Under this transport cylinder 122 are provided two drying lamps 123 facing the peripheral surface of the transport cylinder 122. In this embodiment, components such as these transport cylinder 122 and drying lamps 123 constitute a first drying unit 121 being first drying means.

An impression cylinder 127 is in contact with the transport cylinder 122, the impression cylinder 127 being a double-size cylinder that is situated downstream of the position where the drying lamps 123 face the transport cylinder 122 in the sheet transport direction and that transports a printing sheet W while gripping its leading edge with a gripper device (not illustrated). Another-surface coating cylinder 128 is in contact with an upper portion of this impression cylinder 127, the other-surface coating cylinder 128 being a single cylinder (single-size cylinder) that performs coating on the other surface of a printing sheet W held on the impression cylinder 127. This other-surface coating cylinder 128 is supported to be movable to come into contact (engage) with and separate (disengage) from the impression cylinder 127. On the upper side of and above this other-surface coating cylinder 128 are provided an anilox roller 129 and a chamber coater 130 that feed a coating liquid such as varnish onto the plate surface of a resin plate of the other-surface coating cylinder 128. In this embodiment, components such as these impression cylinder 127, other-surface coating cylinder 128, anilox roller 129, and chamber coater 130 constitute an other-surface coating unit 126 being other-surface coating means.

A transport cylinder 131 is in contact with the impression cylinder 127, the transport cylinder 131 being a cylinder that is situated downstream of the contacting portion of the impression cylinder 127 with the other-surface coating cylinder 128 (other-surface coating position) in the direction of rotation and that transports a printing sheet W while gripping its leading edge with a gripper device (not illustrated). A transport cylinder 133 is in contact with this transport cylinder 131, the transport cylinder 133 being a cylinder that is situated downstream of the contacting portion of the transport cylinder 131 with the impression cylinder 127 in the sheet transport direction and that transports a printing sheet W while gripping its leading edge with a gripper device (not illustrated). Above this transport cylinder 133 are provided two drying lamps 134 facing the peripheral surface of the transport cylinder 133. Components such as these transport cylinder 133 and drying lamps 134 constitute a second drying unit 132 being second drying means.

An impression cylinder 136 is in contact with the transport cylinder 133, the impression cylinder 136 being a double-size cylinder that is situated downstream of the position where the drying lamps 134 face the transport cylinder 133 in the sheet transport direction and that transports a printing sheet W while gripping its leading edge with a gripper device (not illustrated). A one-surface coating cylinder 137 is in contact with a lower portion of this impression cylinder 136, the one-surface coating cylinder 137 being a single cylinder (single-size cylinder) that performs coating on one surface of a printing sheet W held on the impression cylinder 136. This one-surface coating cylinder 137 is supported to be movable to come into contact (engage) with and separate (disengage) from the impression cylinder 136. On the lower side of and under this one-surface coating cylinder 137 are provided an anilox roller 138 and a chamber coater 139 that feed varnish onto the plate surface of a resin plate of the one-surface coating cylinder 137. Components such as these impression cylinder 136, one-surface coating cylinder 137, anilox roller 138, and chamber coater 139 constitute a one-surface coating unit 135 being one-surface coating means.

A delivery cylinder 141 is in contact with the impression cylinder 136, the delivery cylinder 141 being a cylinder that is situated downstream of the contacting portion of the impression cylinder 136 with the one-surface coating cylinder 137 (one-surface coating position) in the direction of rotation. This delivery cylinder 141 is coaxially provided with a sprocket not illustrated, and an endless transport chain 142 provided with a plurality of gripper bars is wound thereon. Under the transport chain 142 are installed a plurality of pile boards on which to pile printing sheets W (in the illustrated example, three pile boards including two pile boards 143*a*, 143*b* for good sheets and one pile board 143*c* for bad sheets) along the direction of travel of the transport chain 142. In this embodiment, components such as these delivery cylinder 141, transport chain 142, and pile boards 143*a* to 143*c* constitute a delivery unit 140 being sheet delivering means.

Moreover, a suction guide 144 is installed above an upper travelling chain portion of the transport chain 142, whereas two drying lamps 145 being third drying means are installed therebelow opposite the suction guide 144.

Furthermore, an inkjet device 147 that prints a mark ("1", "2", or "3" in this embodiment) based on the printing condition as needed on a marginal region on a printing sheet W transported by the delivery cylinder 141 is arranged at a position downstream of the contacting portion between the impression cylinder 136 of the one-surface coating unit 135 and the delivery cylinder 141 of the delivery unit 140 in the sheet transport direction and facing the delivery cylinder 141 of the delivery unit 140. Also, above the feeder board 102 is arranged a mark detection camera 146 being mark imaging means for imaging the above-mentioned marginal region on a printing sheet W on the feeder board 102.

Figure 2:
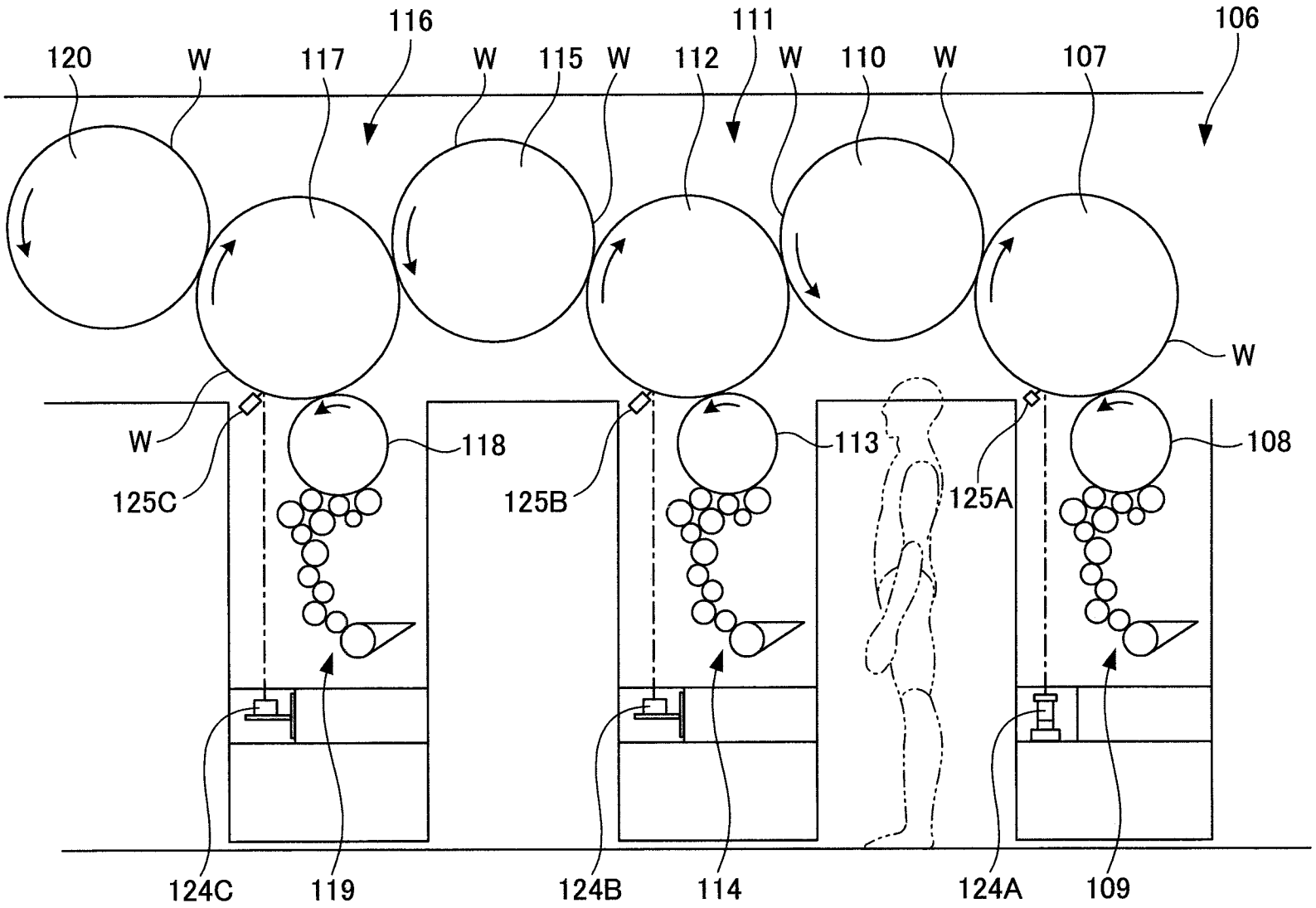
FIG. 2 is a partially enlarged view of a main part of FIG. 1.

Also, as illustrated in FIG. 2, a seal inspection camera 124A that images the seal printed on a printing sheet W held on the impression cylinder 107 is arranged below the impression cylinder 107 at a position near the contacting portion between the impression cylinder 107 and the seal cylinder 108 of the seal printing unit 106 (seal printing position) which is downstream of the contacting portion between the impression cylinder 107 and the seal cylinder 108 (seal printing position) in the direction of rotation of the impression cylinder 107 but upstream of the contacting portion between the impression cylinder 107 and the transport cylinder 110 in the direction of rotation of the impression cylinder 107. A lighting device 125A is arranged near the contacting portion between the impression cylinder 107 and the seal cylinder 108 (seal printing position) and downstream thereof in the direction of rotation of the impression cylinder 107. This lighting device 125A is set up to be capable of illuminating an imaging position on a printing sheet W to be imaged by the seal inspection camera 124A. In this embodiment, components such as these seal inspection camera 124A and lighting device 125A constitute seal imaging means.

A first-number inspection camera 124B that images the first number printed on a printing sheet W held on the impression cylinder 112 is arranged below the impression cylinder 112 at a position near the contacting portion between the impression cylinder 112 and the first-number cylinder 113 of the first-number printing unit 111 (first-number printing position) which is downstream of the contacting portion between the impression cylinder 112 and the first-number cylinder 113 (first-number printing position) in the direction of rotation of the impression cylinder 112 but upstream of the contacting portion between the impression cylinder 112 and the transport cylinder 115 in the direction of rotation of the impression cylinder 112. A lighting device 125B is arranged near the contacting portion between the impression cylinder 112 and the first-number cylinder 113 (first-number printing position) and downstream thereof in the direction of rotation of the impression cylinder 112. This lighting device 125B is set up to be capable of illuminating an imaging position on a printing sheet W to be imaged by the first-number inspection camera 124B. In this embodiment, components such as these first-number inspection camera 124B and lighting device 125B constitute first-number imaging means.

A second-number inspection camera 124C that images the second number printed on a printing sheet W held on the impression cylinder 117 is arranged below the impression cylinder 117 at a position near the contacting portion between the impression cylinder 117 and the second-number cylinder 118 of the second-number printing unit 116 (second-number printing position) which is downstream of the contacting portion between the impression cylinder 117 and the second-number cylinder 118 (second-number printing position) in the direction of rotation of the impression cylinder 117 but upstream of the contacting portion between the impression cylinder 117 and the transport cylinder 120 in the direction of rotation of the impression cylinder 117. A lighting device 125C is arranged near the contacting portion between the impression cylinder 117 and the second-number cylinder 118 (second-number printing position) and downstream thereof in the direction of rotation of the impression cylinder 117. This lighting device 125C is set up to be capable of illuminating an imaging position on a printing sheet W to be imaged by the second-number inspection camera 124C. In this embodiment, components such as these second-number inspection camera 124C and lighting device 125C constitute second-number imaging means.

Figure 3A:
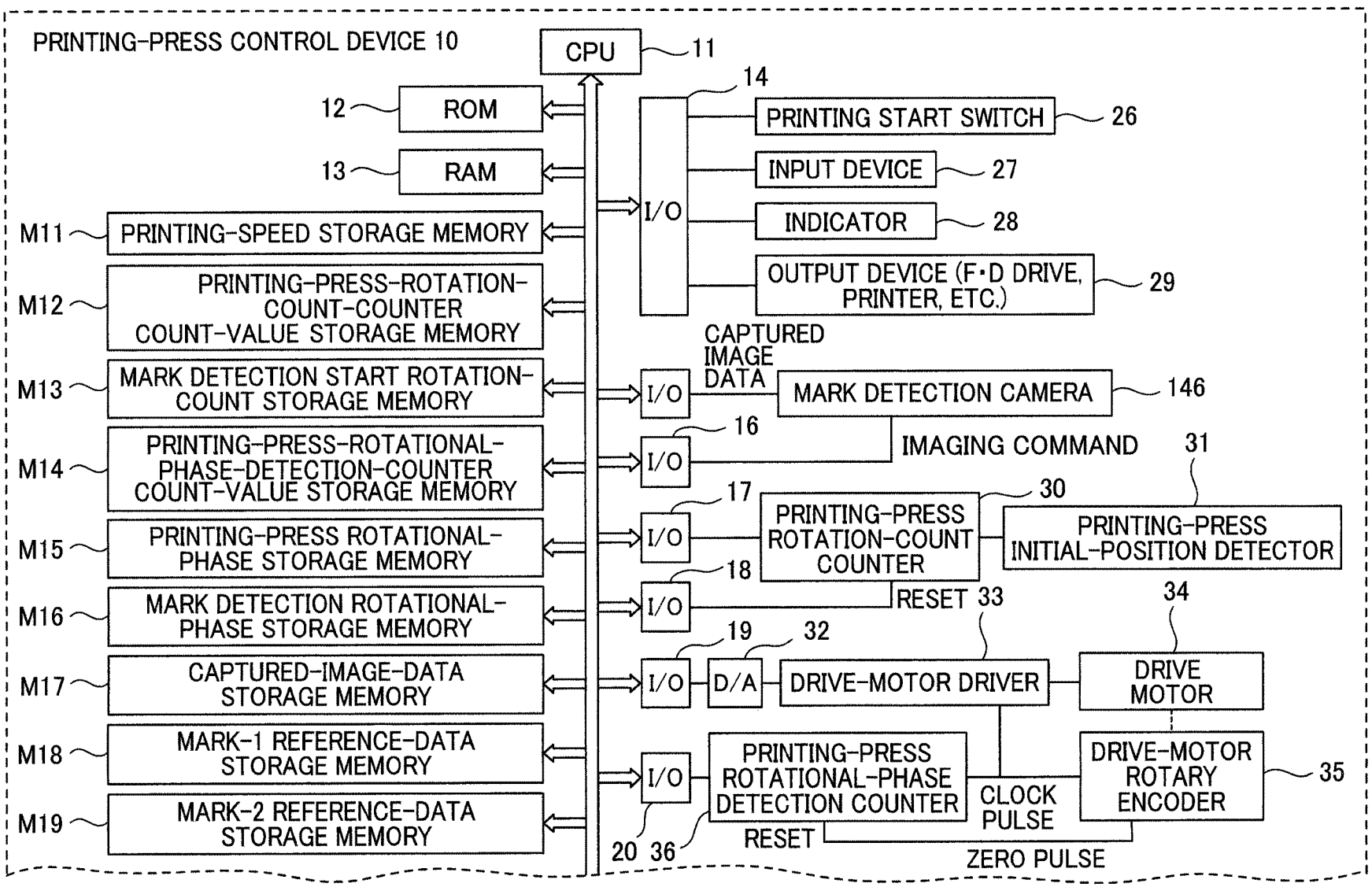
FIG. 3A is a block diagram illustrating the configuration of a printing-press control device according to the embodiment of the present invention.
Figure 3B:
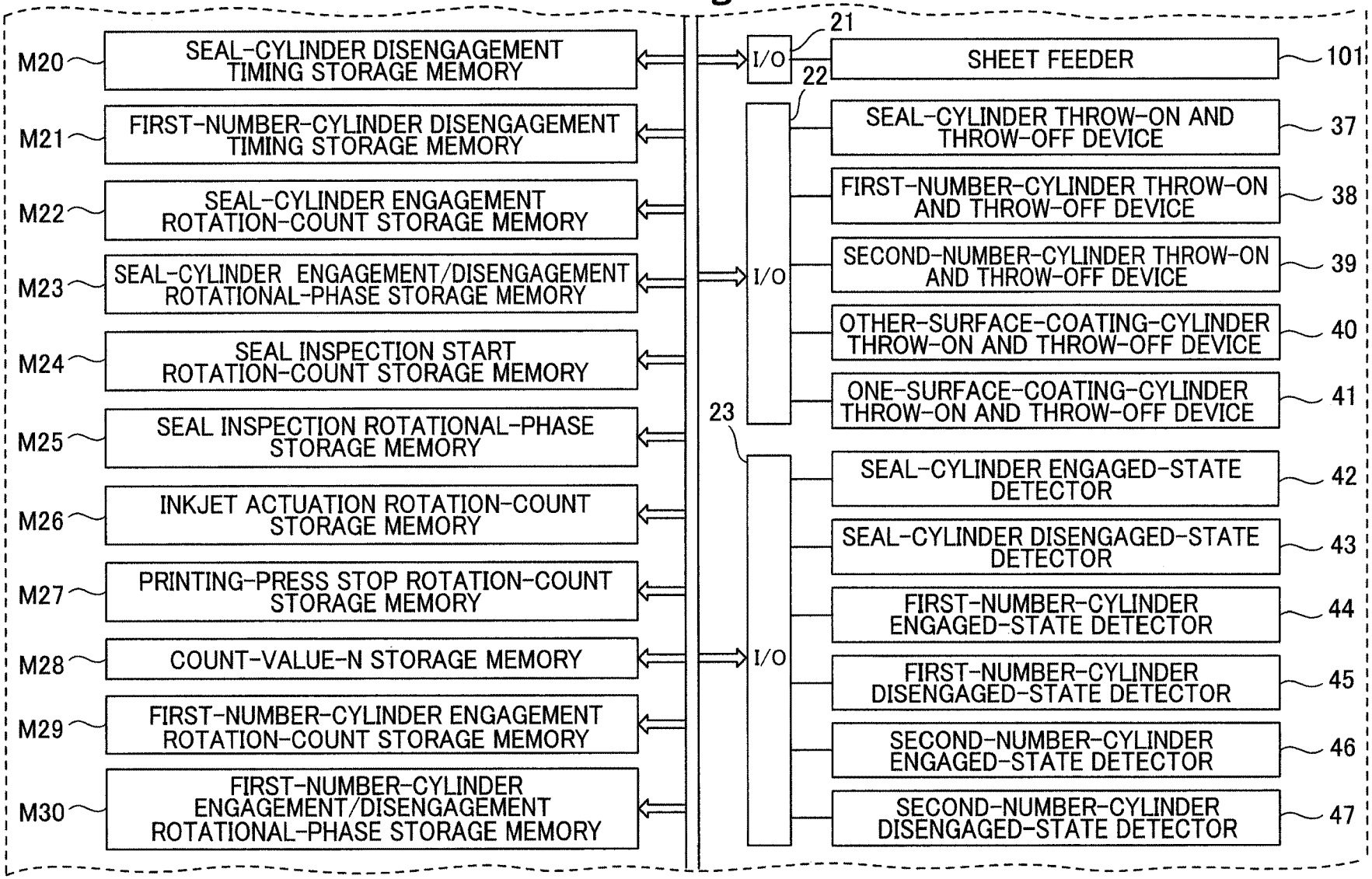
FIG. 3B is a block diagram illustrating the configuration of the printing-press control device according to the embodiment of the present invention.
Figure 3C:
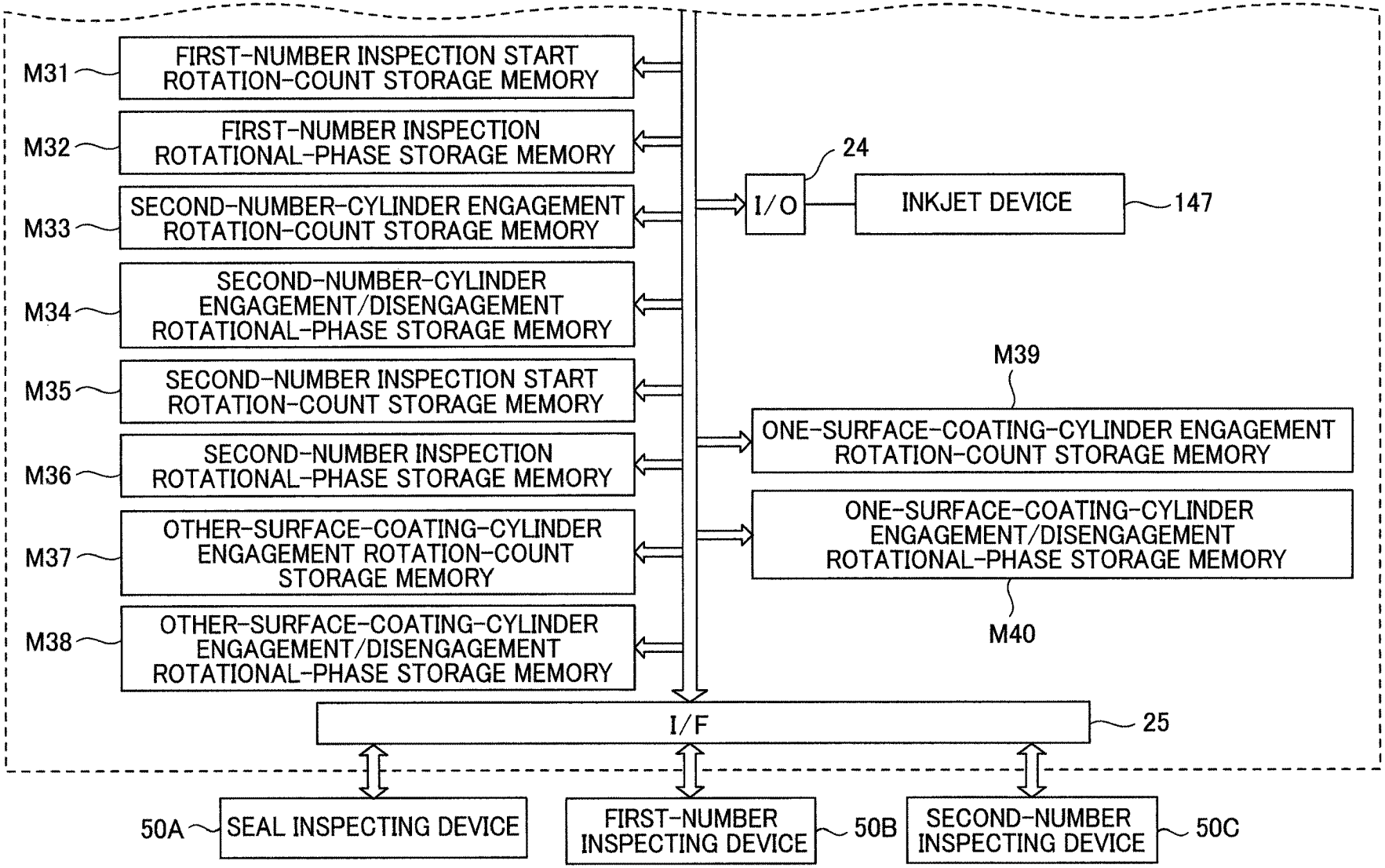
FIG. 3C is a block diagram illustrating the configuration of the printing-press control device according to the embodiment of the present invention.

Also, as illustrated in FIG. 3A to FIG. 3C, a printing-press control device 10 that controls an entire combined printing press 100 according to this embodiment is formed of a CPU 11, a ROM 12, a RAM 13, input-output devices 14 to 24, and an interface 25 connected to each other by a bus line.

To this bus line are connected a printing-speed storage memory M11, a printing-press-rotation-count-counter count-value storage memory M12, a mark detection start rotation-count storage memory M13, a printing-press-rotational-phase-detection-counter count-value storage memory M14, a printing-press rotational-phase storage memory M15, a mark detection rotational-phase storage memory M16, an captured-image-data storage memory M17, a mark-1 reference-data storage memory M18, and a mark-2 reference-data storage memory M19.

Further, to the bus line are connected a seal-cylinder disengagement timing storage memory M20, a first-number-cylinder disengagement timing storage memory M21, a seal-cylinder engagement rotation-count storage memory M22, a seal-cylinder engagement/disengagement rotational-phase storage memory M23, a seal inspection start rotation-count storage memory M24, a seal inspection rotational-phase storage memory M25, an inkjet actuation rotation-count storage memory M26, a printing-press stop rotation-count storage memory M27, a count-value-N storage memory M28, a first-number-cylinder engagement rotation-count storage memory M29, and a first-number-cylinder engagement/disengagement rotational-phase storage memory M30.

Further, to the bus line are connected a first-number inspection start rotation-count storage memory M31, a first-number inspection rotational-phase storage memory M32, a second-number-cylinder engagement rotation-count storage memory M33, a second-number-cylinder engagement/disengagement rotational-phase storage memory M34, a second-number inspection start rotation-count storage memory M35, a second-number inspection rotational-phase storage memory M36, an other-surface-coating-cylinder engagement rotation-count storage memory M37, an other-surface-coating-cylinder engagement/disengagement rotational-phase storage memory M38, a one-surface-coating-cylinder engagement rotation-count storage memory M39, and a one-surface-coating-cylinder engagement/disengagement rotational-phase storage memory M40.

Also, to the input-output device 14 are connected a printing start switch 26, an input device 27 such as a keyboard and/or various switches and buttons, an indicator 28 such as a CRT and/or a lamp, and an output device 29 such as a floppy (registered trademark) disk drive and/or a printer.

Also, the mark detection camera 146 is connected to the input-output devices 15, 16. An imaging command is inputted from the input-output device 16 into the mark detection camera 146, and captured image data obtained by the mark detection camera 146 is outputted to the input-output device 15.

Also, a printing-press rotation-count counter 30 is connected to the input-output device 17, and a printing-press initial-position detector 31 is connected to this printing-press rotation-count counter 30. This printing-press initial -position detector 31 is adapted to output one pulse each time the combined printing press 100 prints one printing sheet W. The printing-press rotation-count counter 30 is also connected to the input-output device 18, and a reset signal is inputted thereinto from the input-output device 18.

Also, a drive-motor driver 33 is connected to the input-output device 19 through a D-A converter 32, and a drive motor 34 and a drive-motor rotary encoder 35 are connected to this drive-motor driver 33.

A printing-press rotational-phase detection counter 36 is connected to the input-output device 20, and the drive-motor rotary encoder 35 is connected to this printing-press rotational-phase detection counter 36. Here, the drive-motor rotary encoder 35 is, for example, directly mounted to a rear end portion of the output shaft of the drive motor 34 and adapted to rotate 360 degrees each time the printing units 106, 111, 116 print one printing sheet W, output one zero pulse to reset the printing-press rotational-phase detection counter 36 each time the drive-motor rotary encoder 35 rotates 360 degrees, and output a clock pulse to the drive-motor driver 33 and the printing-press rotational-phase detection counter 36 each time the drive motor 34 rotates a predetermined angle.

Also, the sheet feeder 101 is connected to the input-output device 21.

To the input-output device 22 are connected a seal-cylinder throw-on and throw-off device 37 as seal-cylinder contacting-separating-movement means, a first-number-cylinder throw-on and throw-off device 38 as first-number-cylinder contacting-separating-movement means, a second-number-cylinder throw-on and throw-off device 39 as second-number-cylinder contacting-separating-movement means, an other-surface-coating-cylinder throw-on and throw-off device 40 as other-surface-coating-cylinder contacting-separating-movement means, and a one-surface-coating-cylinder throw-on and throw-off device 41 as one-surface-coating-cylinder contacting-separating-movement means for engagement (contacting movement) and disengagement (separating movement) of the seal cylinder 108, the first-number cylinder 113, the second-number cylinder 118, the other-surface coating cylinder 128, and the one-surface coating cylinder 137, respectively.

Also, to the input-output device 23 are connected: a seal-cylinder engaged-state detector 42 that outputs a signal when the seal cylinder 108 is in contact with the impression cylinder 107 based on the state of the seal-cylinder throw-on and throw-off device 37; a seal-cylinder disengaged-state detector 43 that outputs a signal when the seal cylinder 108 is separated from the impression cylinder 107 based on the state of the seal-cylinder throw-on and throw-off device 37; a first-number-cylinder engaged-state detector 44 that outputs a signal when the first-number cylinder 113 is in contact with the impression cylinder 112 based on the state of the first-number-cylinder throw-on and throw-off device 38; a first-number-cylinder disengaged-state detector 45 that outputs a signal when the first-number cylinder 113 is separated from the impression cylinder 112 based on the state of the first-number-cylinder throw-on and throw-off device 38; a second-number-cylinder engaged-state detector 46 that outputs a signal when the second-number cylinder 118 is in contact with the impression cylinder 117 based on the state of the second-number-cylinder throw-on and throw-off device 39; and a second-number-cylinder disengaged-state detector 47 that outputs a signal when the second-number cylinder 118 is separated from the impression cylinder 117 based on the state of the second-number-cylinder throw-on and throw-off device 39.

Also, the inkjet device 147 is connected to the input-output device 24.

Moreover, to the interface 25 are connected at least: a seal inspecting device 50A that determines whether or not the seal printing is satisfactory based on the image data captured by the seal inspection camera 124A, and issues a warning if a trouble has occurred; a first-number inspecting device 50B that determines whether or not the first-number printing is satisfactory based on the image data captured by the first-number inspection camera 124B, and issues a warning if a trouble has occurred; and a second-number inspecting device 50C that determines whether or not the second-number printing is satisfactory based on the image data captured by the second-number inspection camera 124C, and issues a warning if a trouble has occurred.

Figure 4:
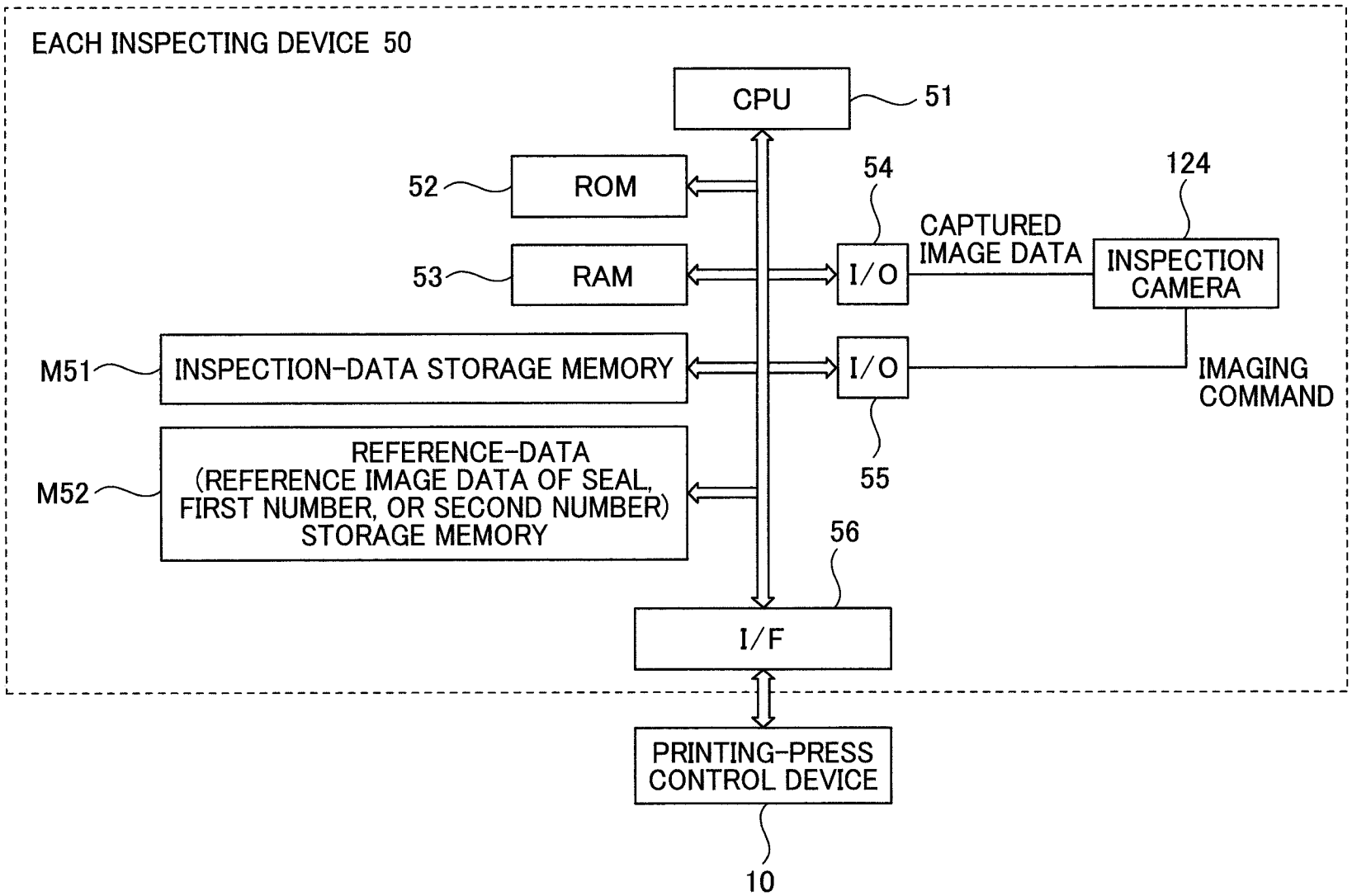
FIG. 4 is a block diagram illustrating the configuration of each inspecting device according to the embodiment of the present invention.
Figure 5A:
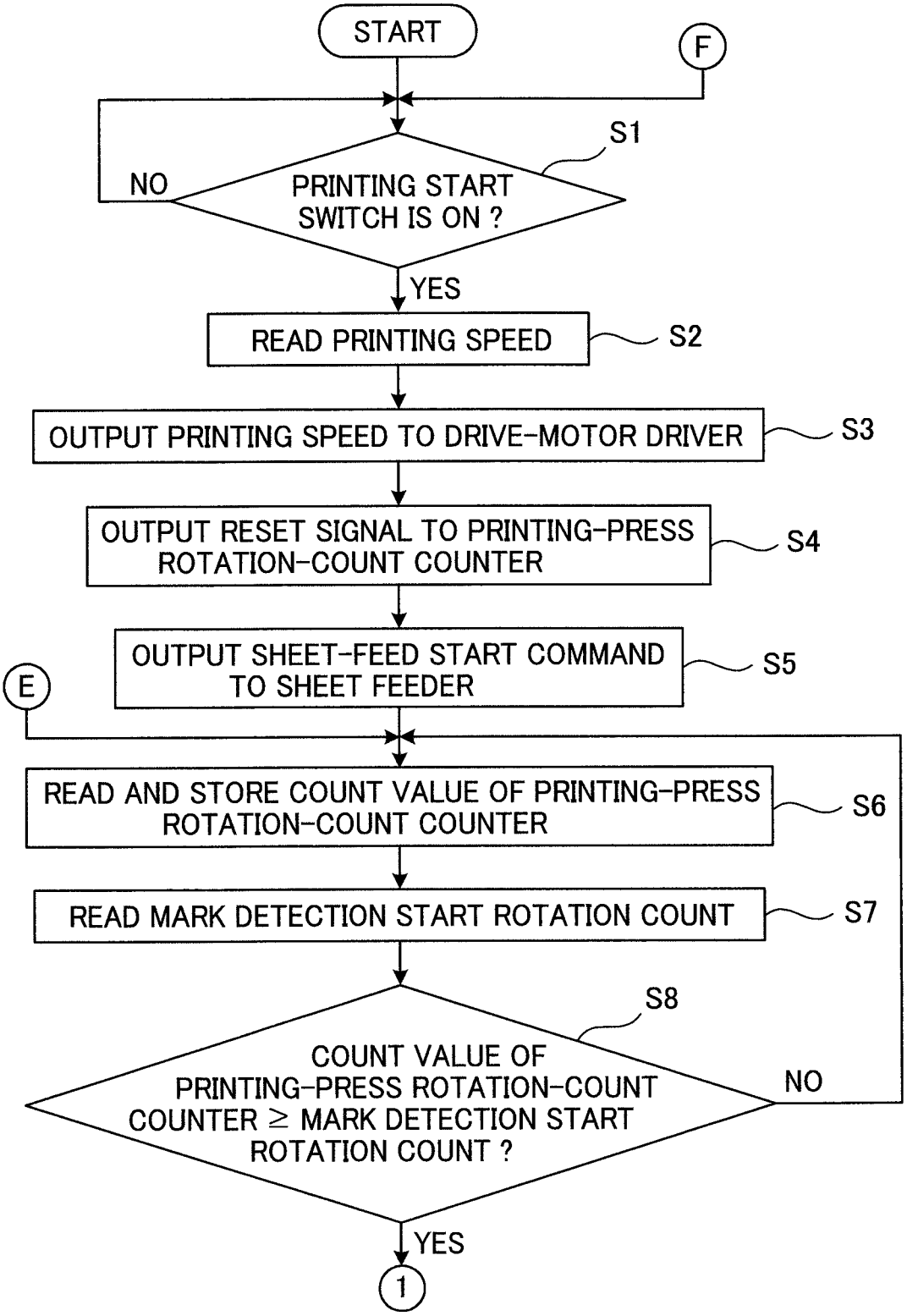
FIG. 5A is a flowchart illustrating the operation of the printing-press control device according to the embodiment of the present invention.
Figure 5B:
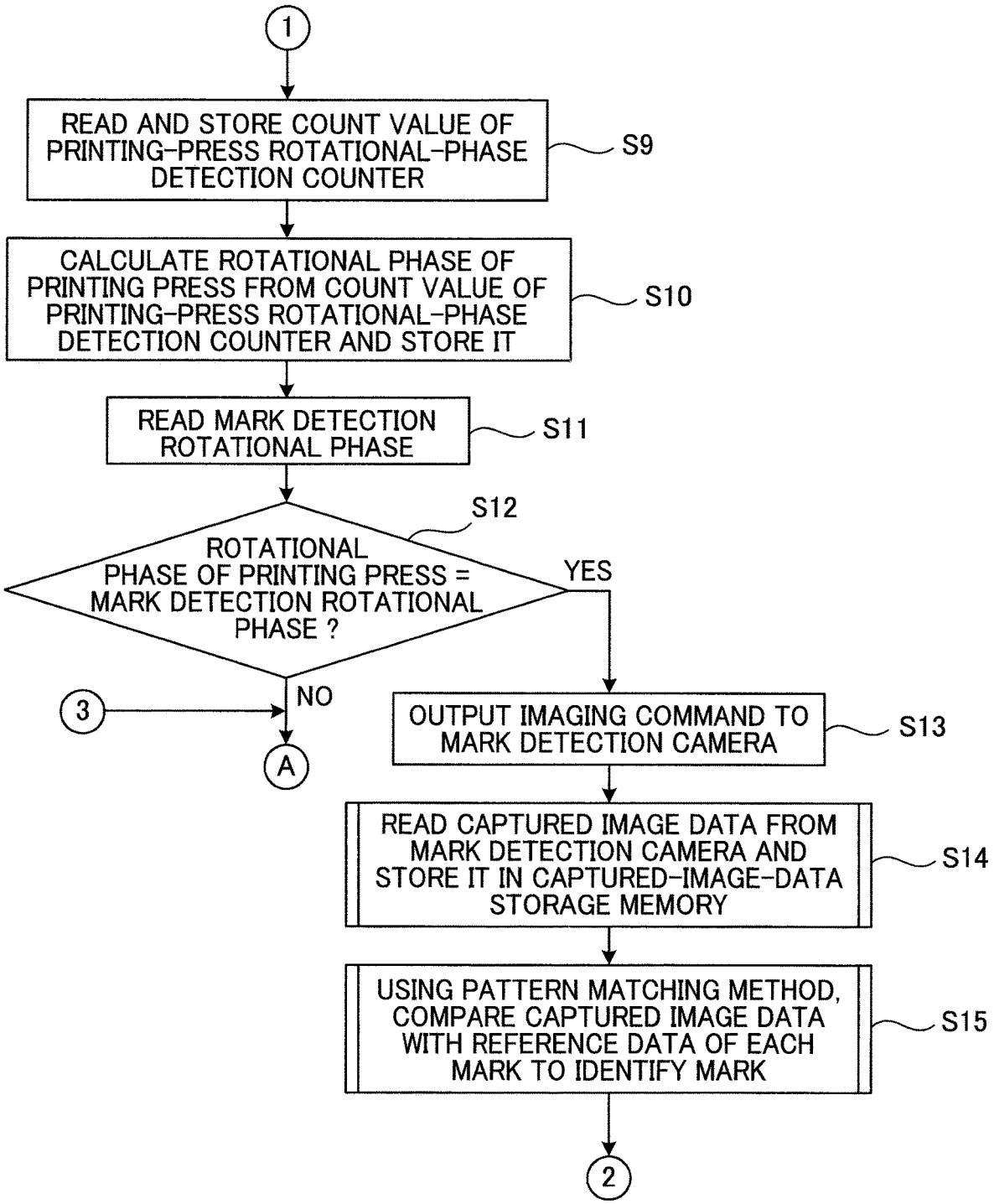
FIG. 5B is a flowchart illustrating the operation of the printing-press control device according to the embodiment of the present invention.
Figure 5C:
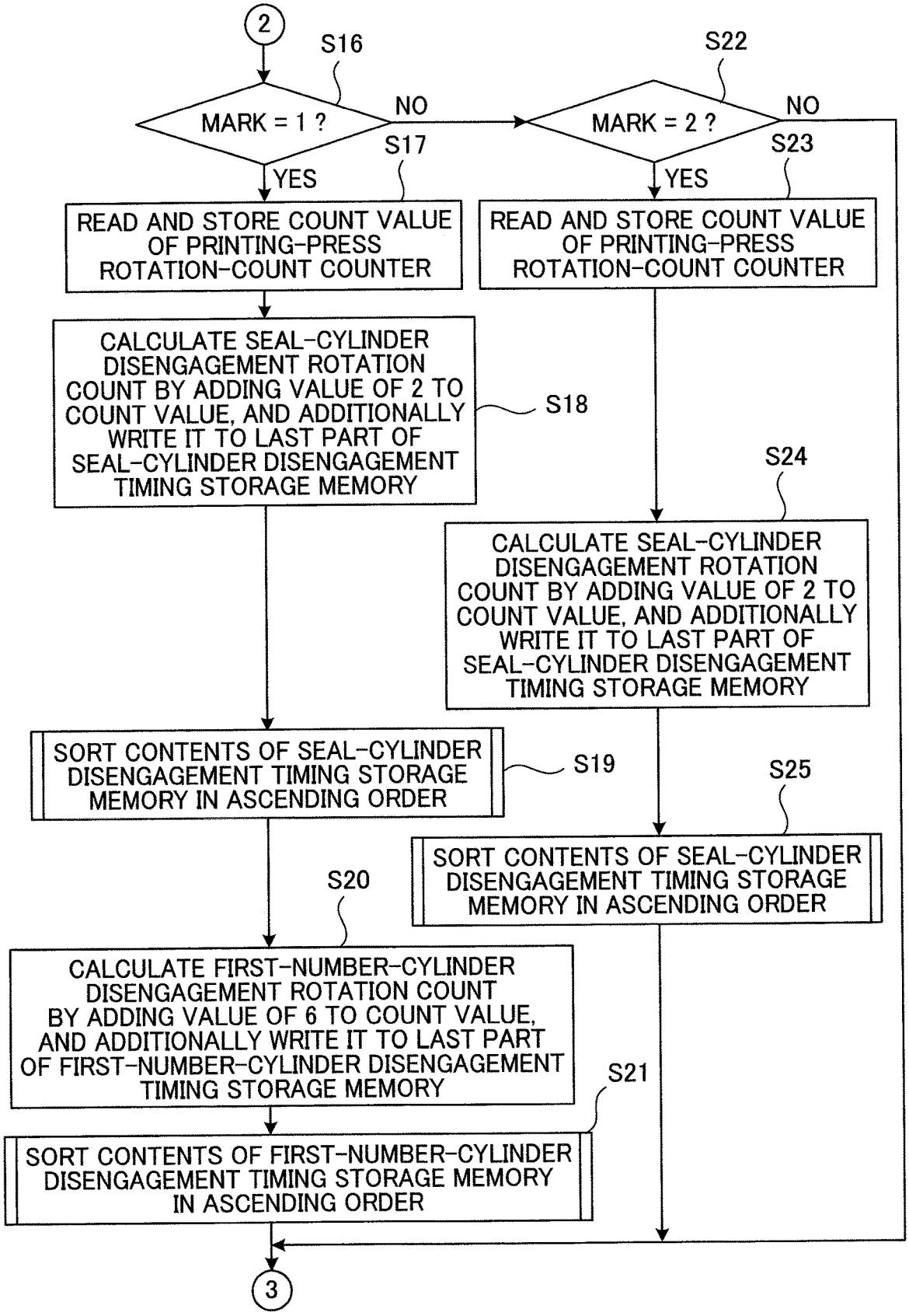
FIG. 5C is a flowchart illustrating the operation of the printing-press control device according to the embodiment of the present invention.
Figure 6A:
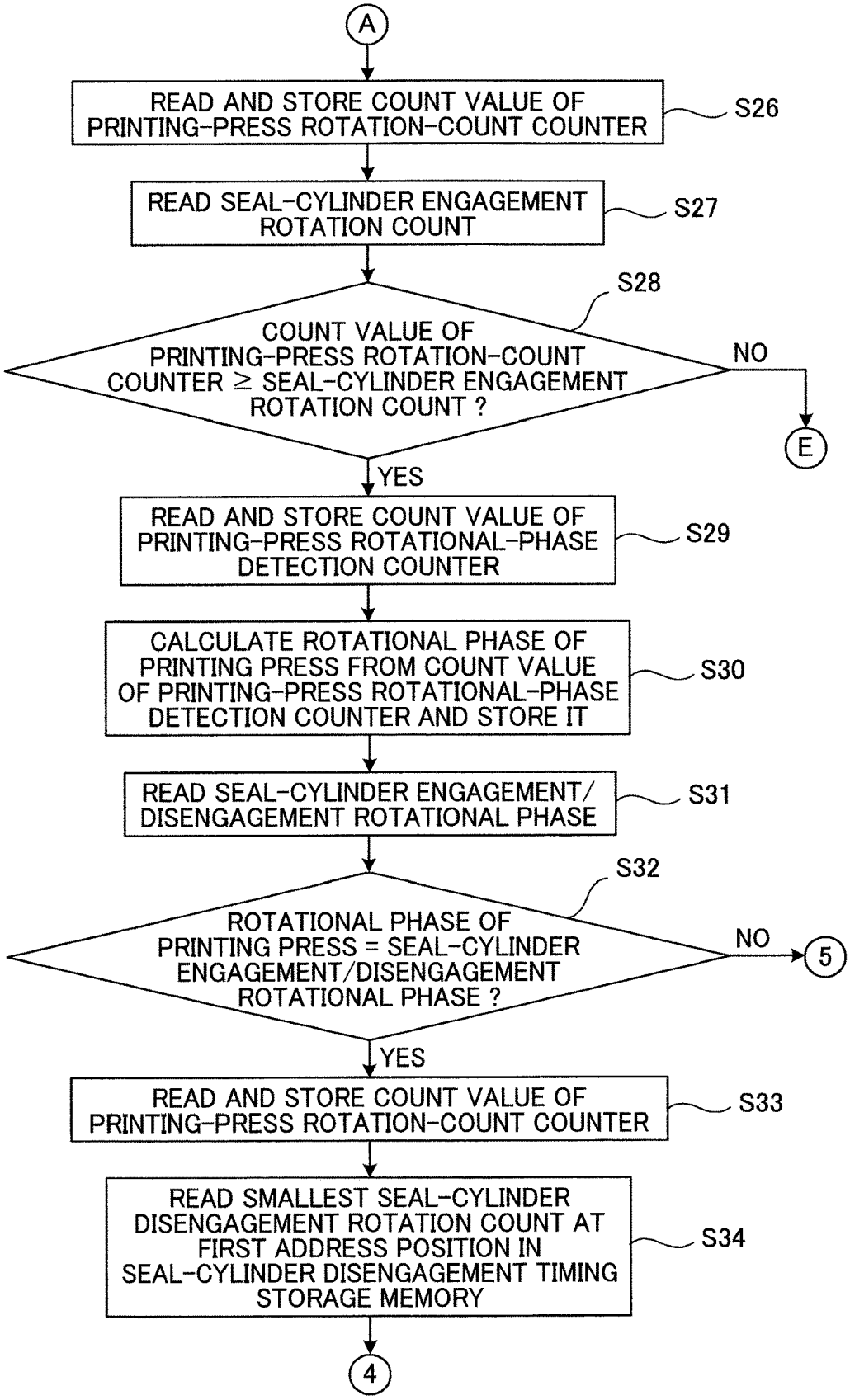
FIG. 6A is a flowchart illustrating the operation of the printing-press control device according to the embodiment of the present invention.
Figure 6C:
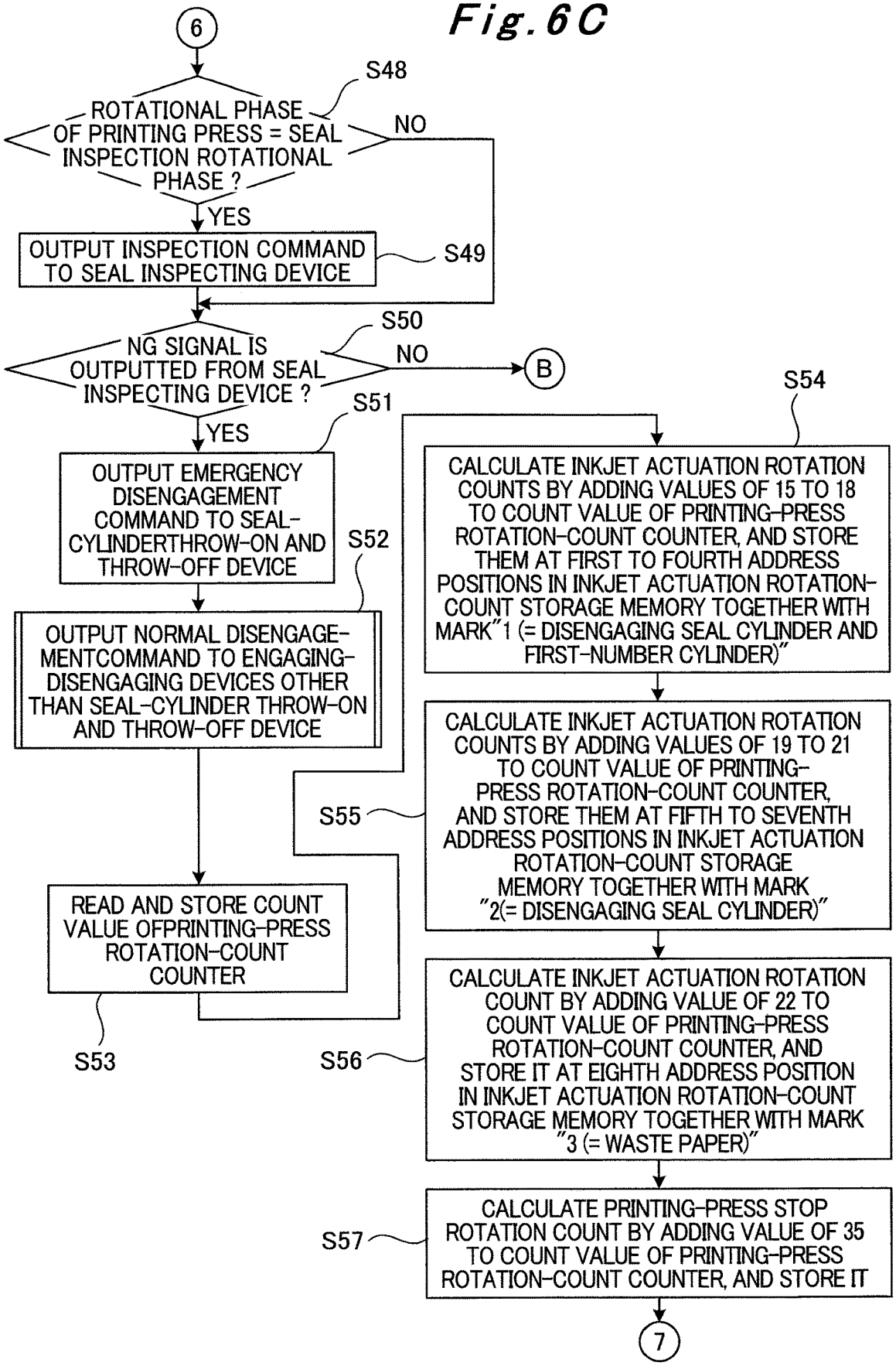
FIG. 6C is a flowchart illustrating the operation of the printing-press control device according to the embodiment of the present invention.
Figure 6D:
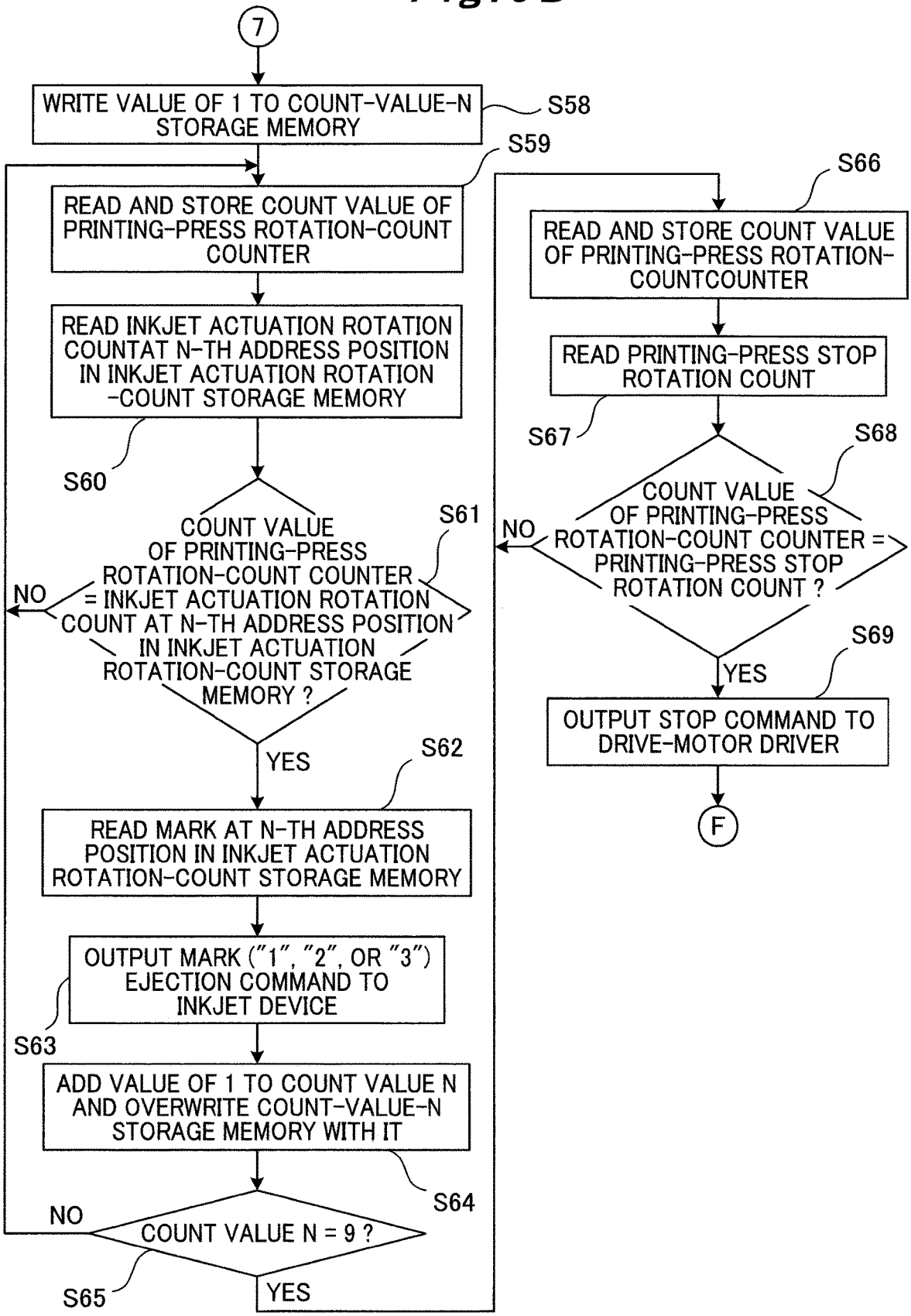
FIG. 6D is a flowchart illustrating the operation of the printing-press control device according to the embodiment of the present invention.
Figure 7A:
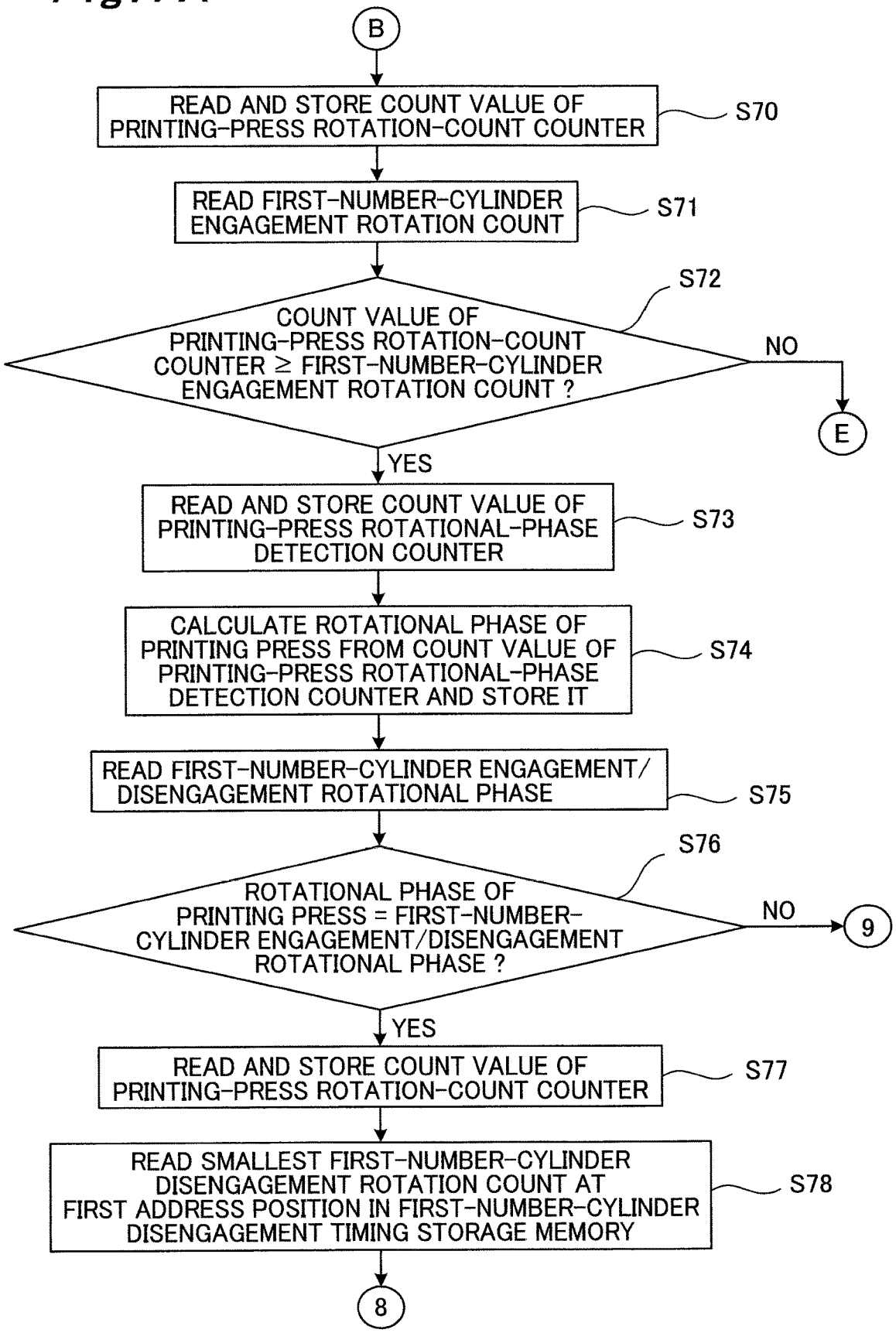
FIG. 7A is a flowchart illustrating the operation of the printing-press control device according to the embodiment of the present invention.
Figure 7C:
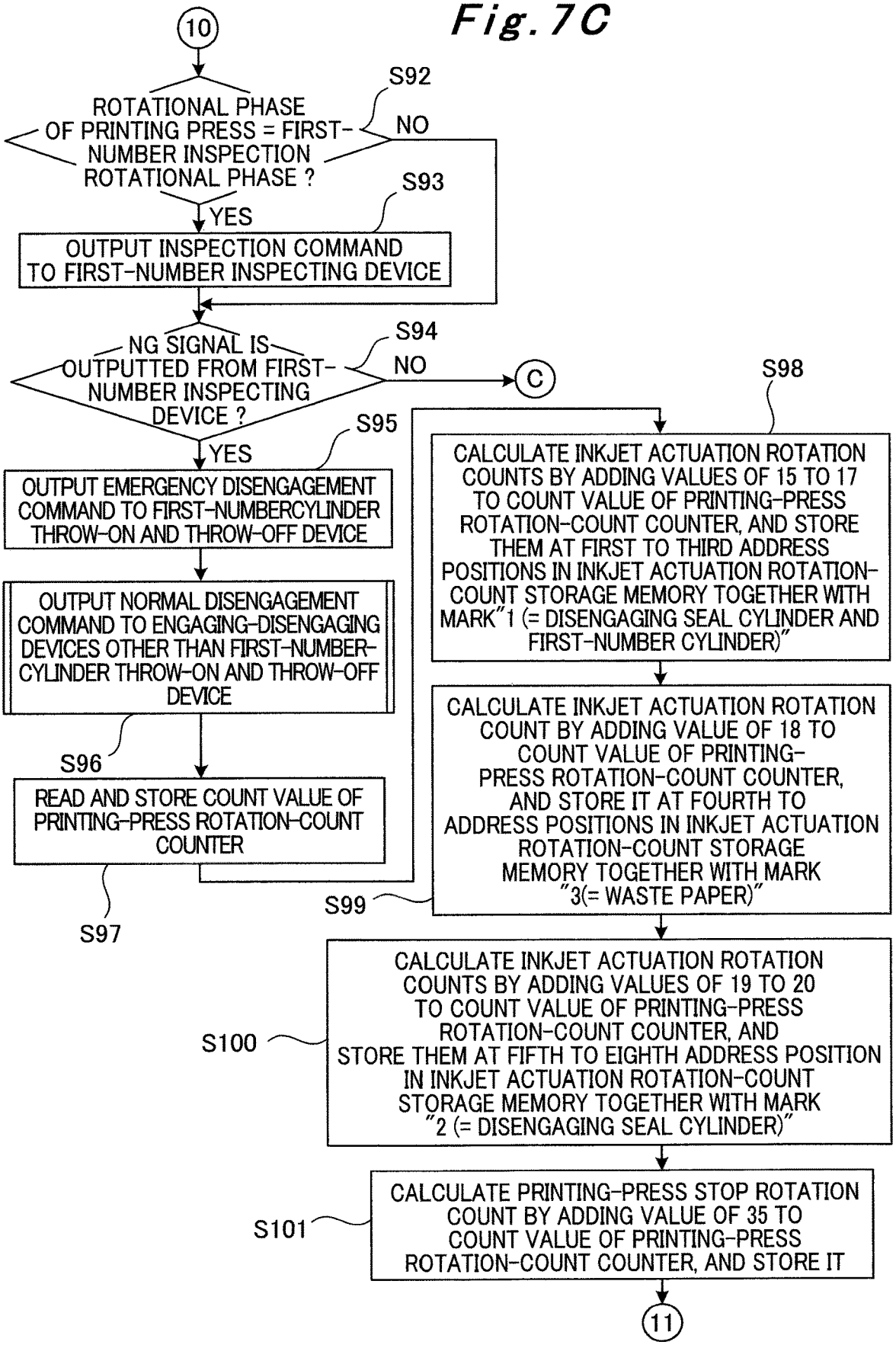
FIG. 7C is a flowchart illustrating the operation of the printing-press control device according to the embodiment of the present invention.
Figure 7D:
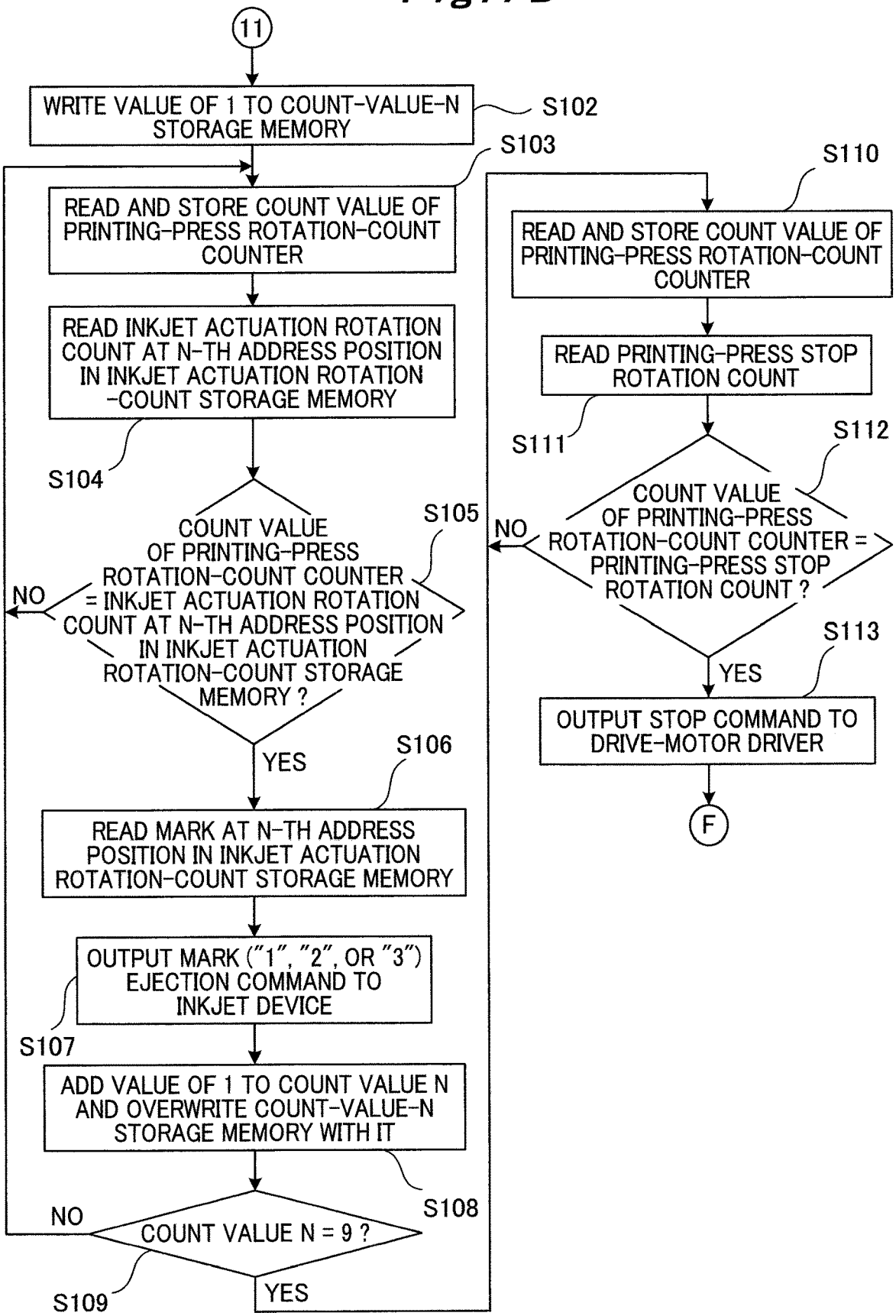
FIG. 7D is a flowchart illustrating the operation of the printing-press control device according to the embodiment of the present invention.
Figure 8A:
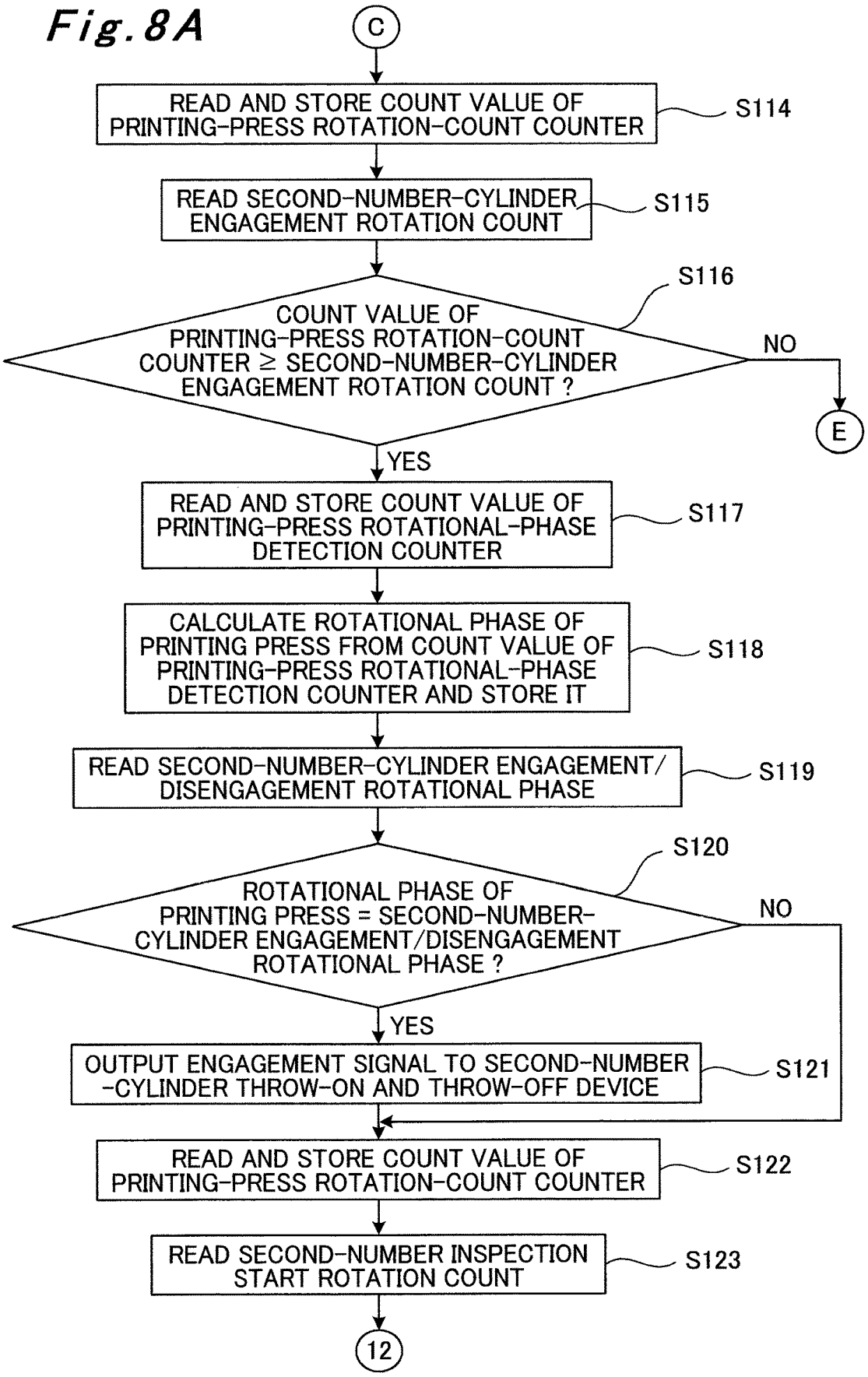
FIG. 8A is a flowchart illustrating the operation of the printing-press control device according to the embodiment of the present invention.
Figure 8B:
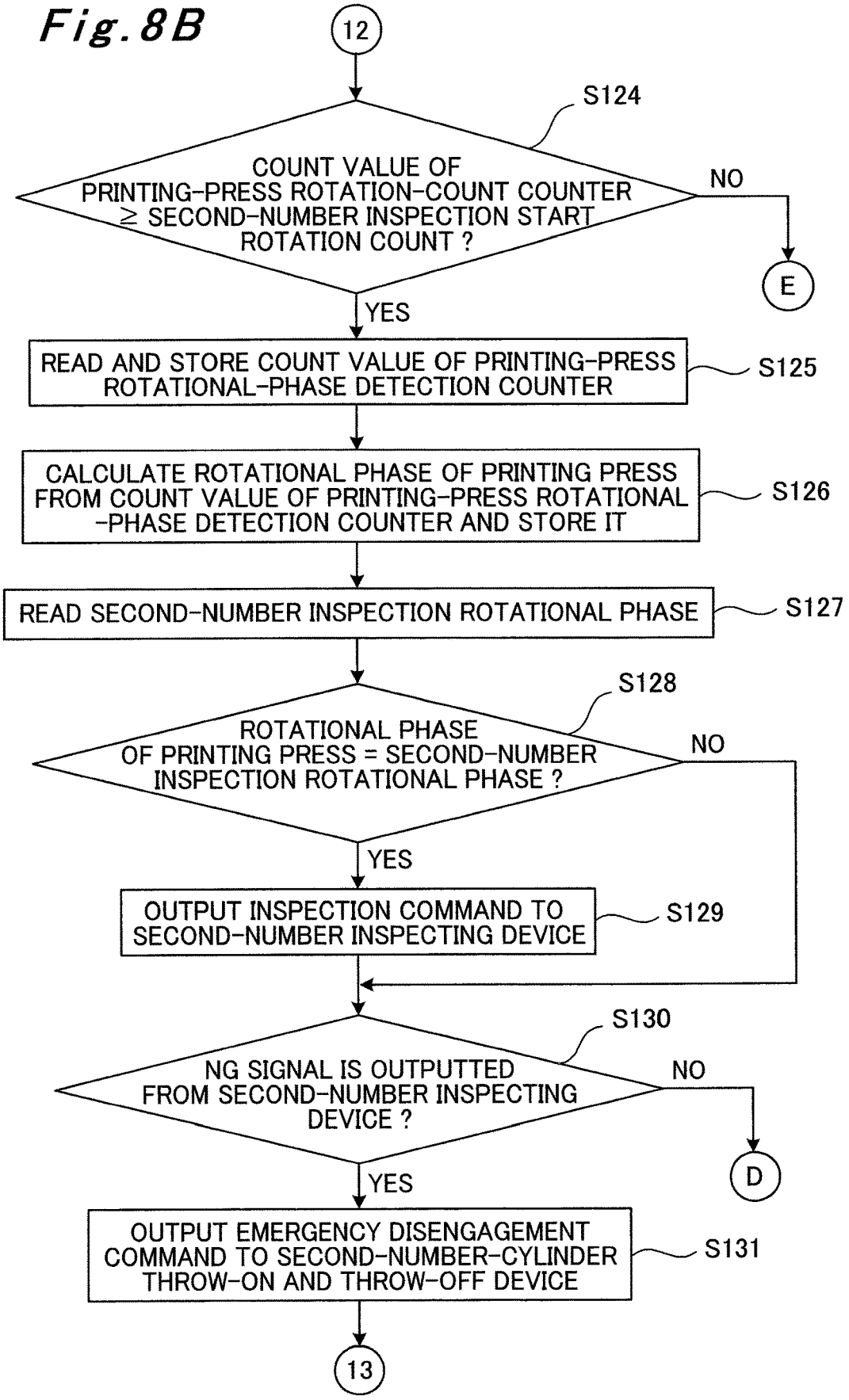
FIG. 8B is a flowchart illustrating the operation of the printing-press control device according to the embodiment of the present invention.
Figure 8C:
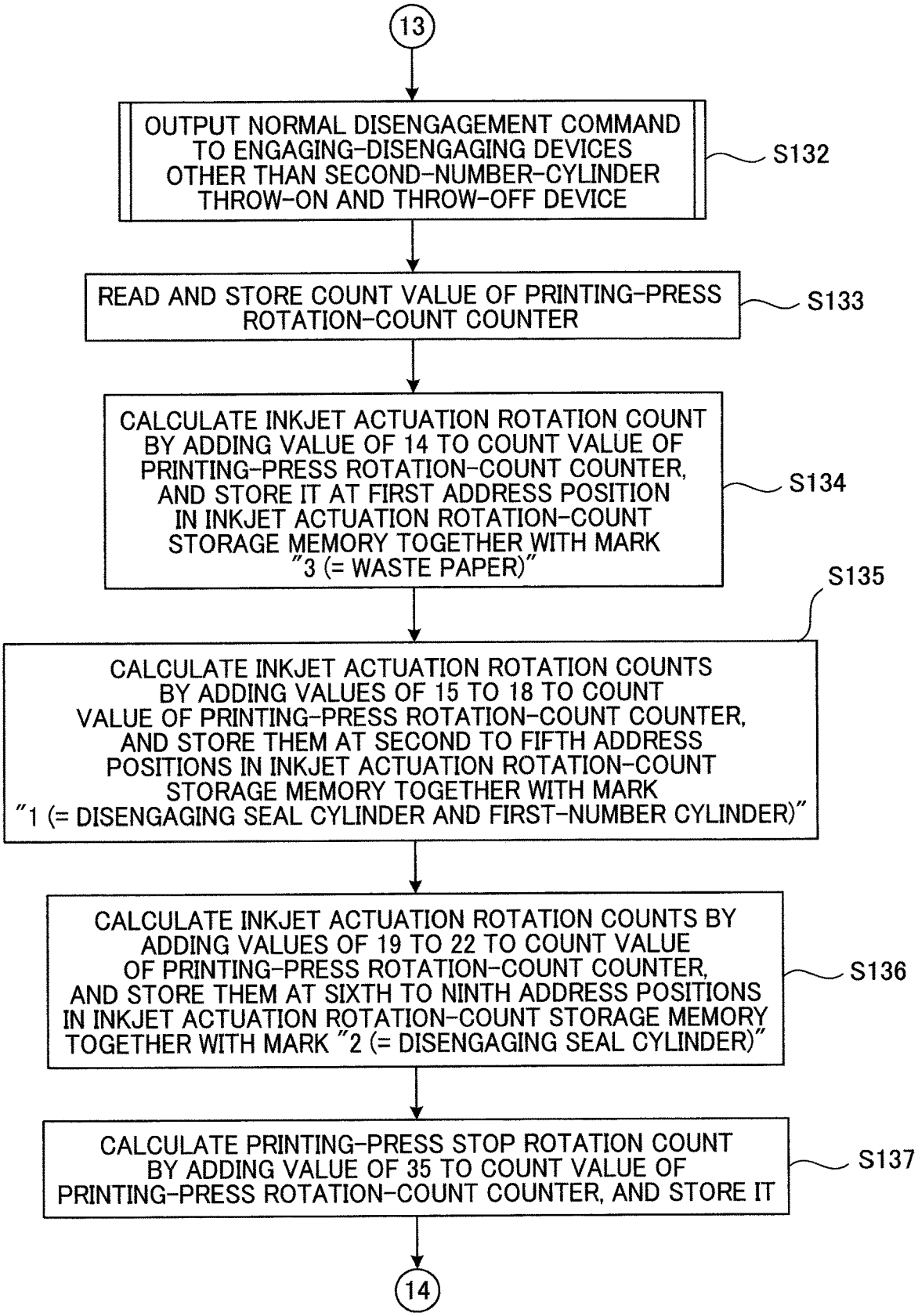
FIG. 8C is a flowchart illustrating the operation of the printing-press control device according to the embodiment of the present invention.
Figure 8D:
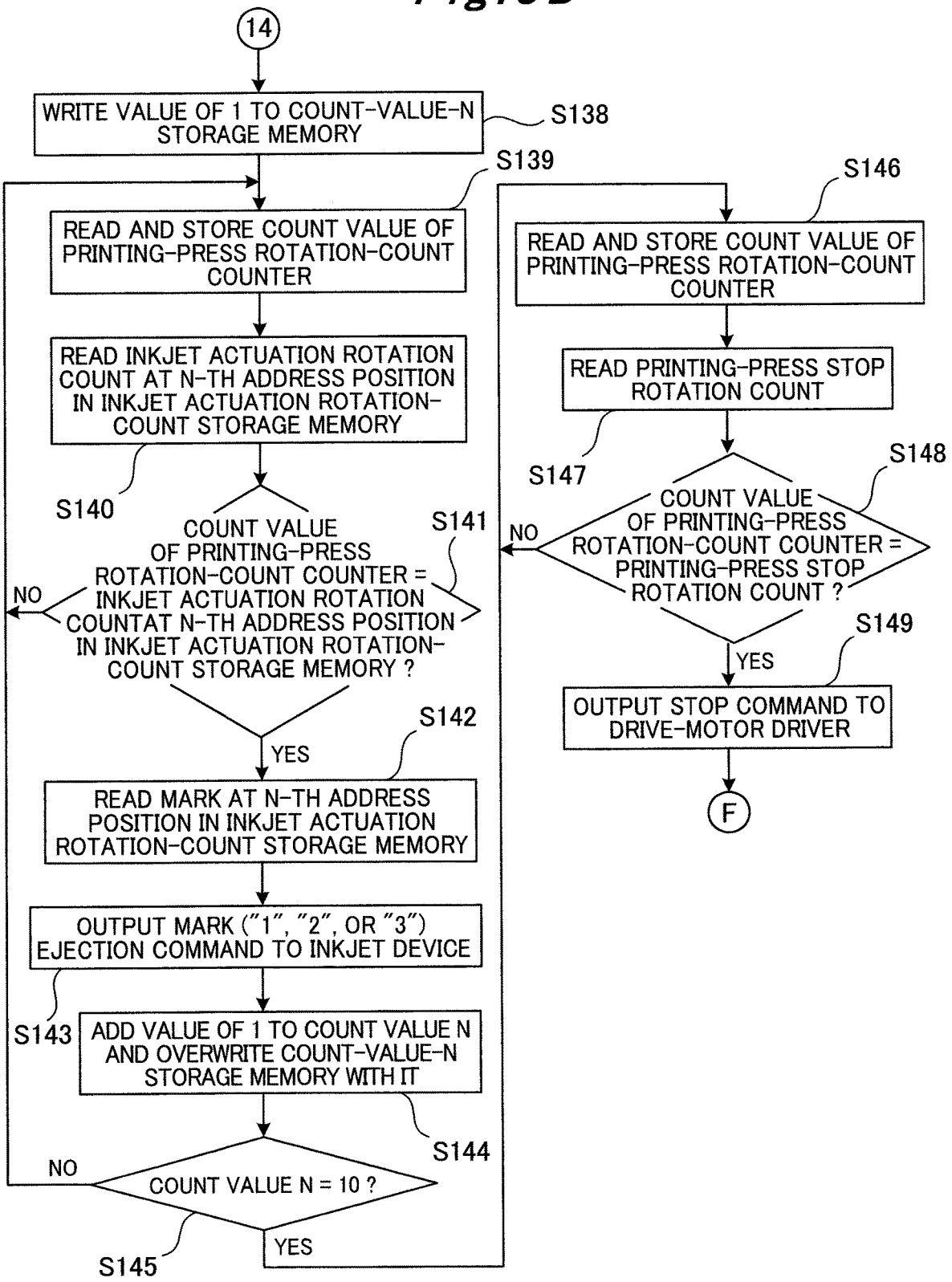
FIG. 8D is a flowchart illustrating the operation of the printing-press control device according to the embodiment of the present invention.
Figure 9A:
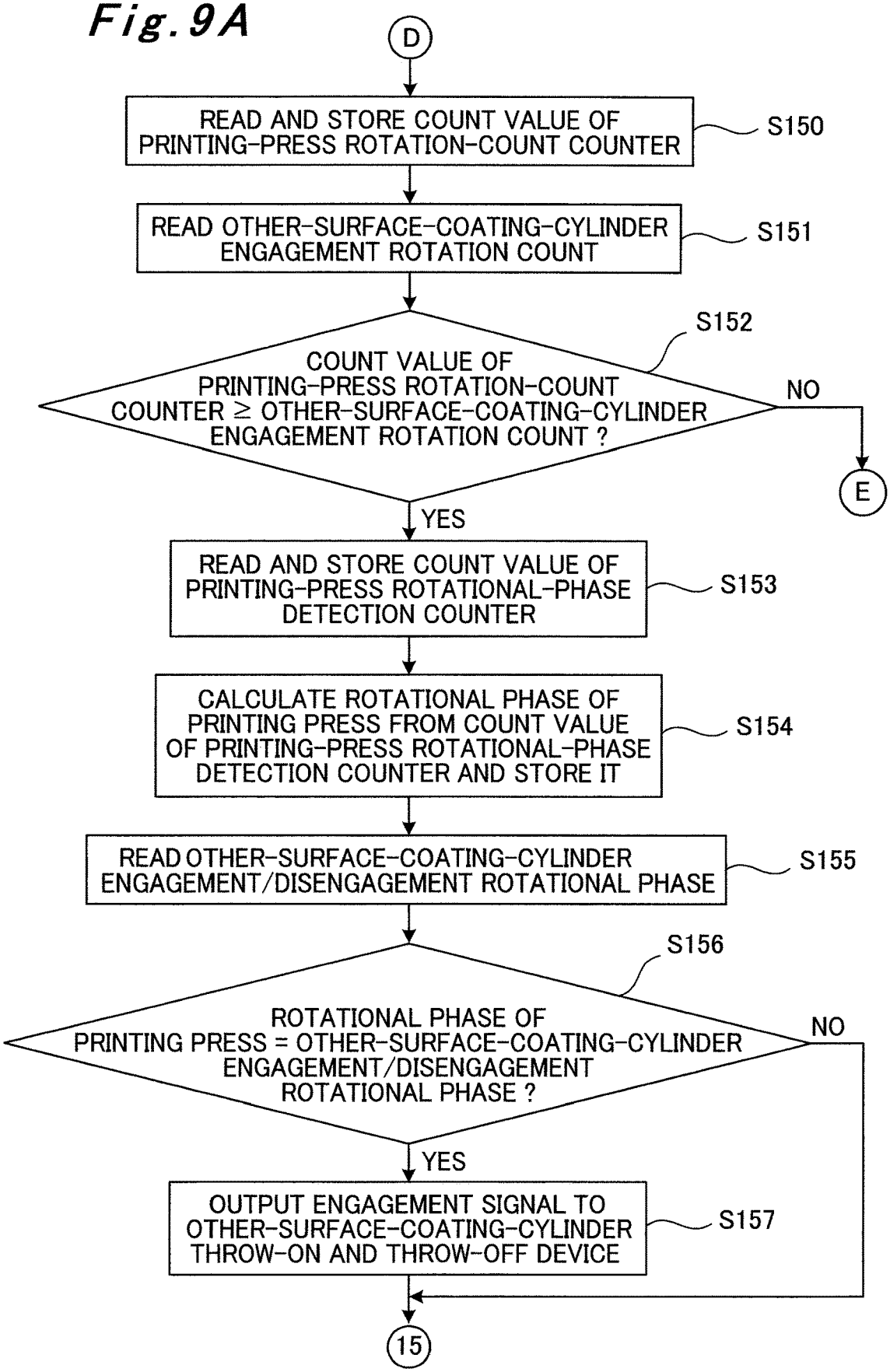
FIG. 9A is a flowchart illustrating the operation of the printing-press control device according to the embodiment of the present invention.
Figure 9B:
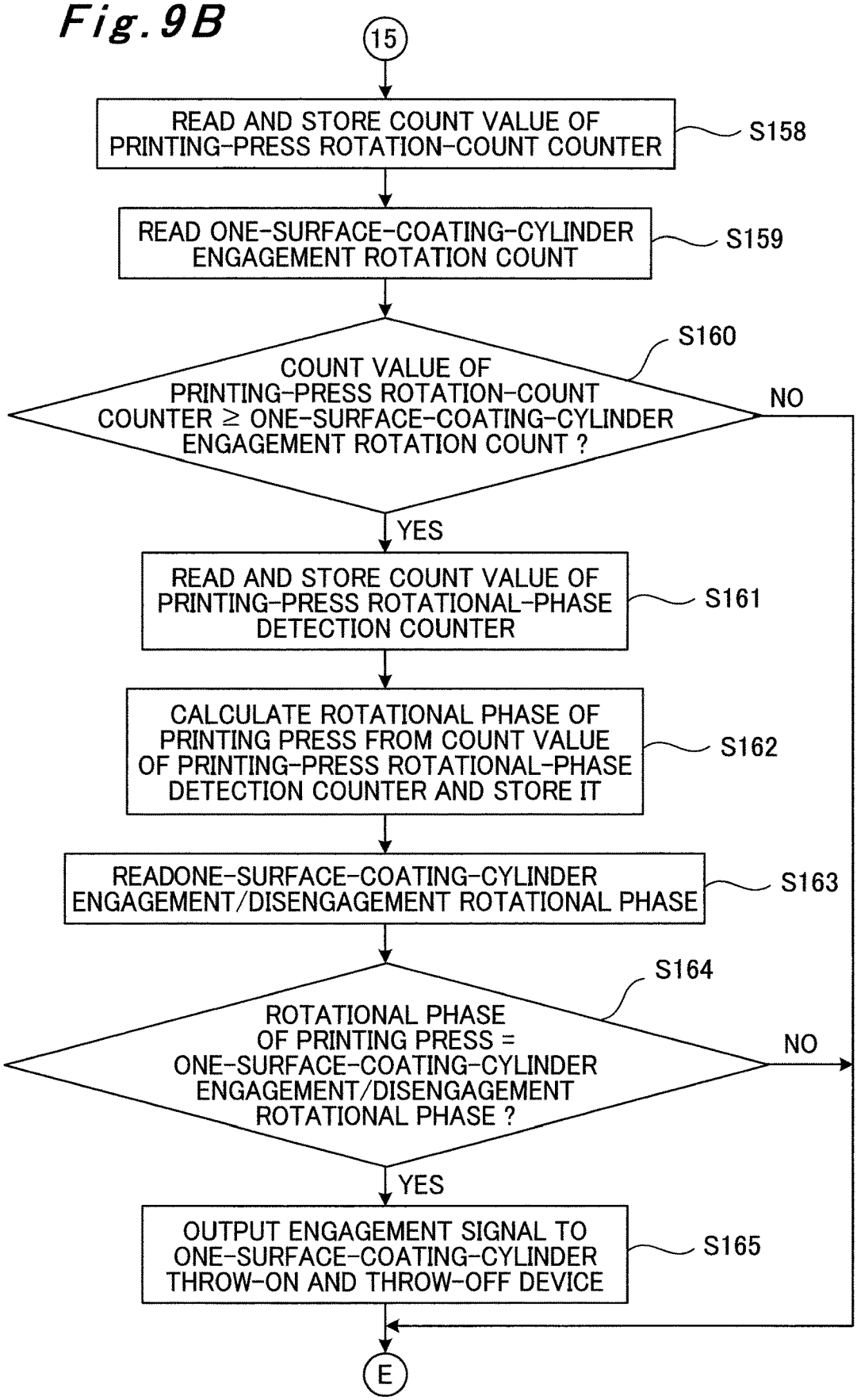
FIG. 9B is a flowchart illustrating the operation of the printing-press control device according to the embodiment of the present invention.

Further, as illustrated in FIG. 4, each inspecting device 50 (seal inspecting device 50A, first-number inspecting device 50B, second-number inspecting device 50C) is formed of a CPU 51, a ROM 52, a RAM 53, input-output devices 54, 55, and an interface 56 connected to each other by a bus line.

An inspection-data storage memory M51 and a reference-data (reference image data of the seal, the first number, or the second number) storage memory M52 are connected to this bus line.

An inspection camera 124 (seal inspection camera 124A, first-number inspection camera 124B, second-number inspection camera 124C) is connected to the input-output devices 54, 55 of each inspecting device 50. An imaging command is inputted from the input-output device 55 into the inspection camera 124, and captured image data obtained by the inspection camera 124 is outputted to the input-output device 54.

Also, the interface 56 of each inspecting device 50 is connected to the printing-press control device 10.

The procedure of printing by the combined printing press 100 according to this embodiment with a configuration as above will be briefly described below.

In the combined printing press 100 according to this embodiment, as printing sheets W are individually fed from the sheet feeder 101 onto the feeder board 102, the printing sheets W are individually passed by the swing arm shaft pregripper 103 to the gripper device of the transfer cylinder 104 and gripped at its leading edge. The gripping of the leading edge is changed from the gripper device of the transfer cylinder 104 to that of the transfer cylinder 105, and the gripping of the leading edge is then changed to a gripper device of the impression cylinder 107 of the seal printing unit 106 such that the printing sheet W is held with its one surface (front surface) facing outward and transported.

As the printing sheet W passes between the impression cylinder 107 and the seal cylinder 108, ink that has been transferred in advance onto the surface of the seal cylinder 108 from the inking device 109 is transferred onto the one surface of the printing sheet W, which is held and transported on the peripheral surface of the impression cylinder 107, so that seal printing is performed.

The printing sheet W after the seal printing performed on the one surface on the impression cylinder 107 then has the gripping of its leading edge changed to a gripper device of the transport cylinder 110 and the gripping of the leading edge is thereafter changed from the gripper device of this transport cylinder 110 to that of the impression cylinder 112 of the first-number printing unit 111, so that the printing sheet W is held and transported on the impression cylinder 112 with the one surface facing outward.

As the printing sheet W passes between the impression cylinder 112 and the first-number cylinder 113, ink that has been transferred in advance onto the surface of the first-number cylinder 113 from the inking device 114 is transferred onto the one surface of the printing sheet W, which is held and transported on the peripheral surface of the impression cylinder 112, so that first-number printing is performed on the one surface.

The printing sheet W after the first-number printing performed on the one surface on the impression cylinder 112 then has the gripping of its leading edge changed to a gripper device of the transport cylinder 115 and the gripping of the leading edge is thereafter changed from the gripper device of this transport cylinder 115 to that of the impression cylinder 117 of the second-number printing unit 116, so that the printing sheet W is held and transported on the impression cylinder 117 with the one surface facing outward.

As the printing sheet W passes between the impression cylinder 117 and the second-number cylinder 118, ink that has been transferred in advance onto the surface of the second-number cylinder 118 from the inking device 119 is transferred onto the one surface of the printing sheet W, which is held and transported on the peripheral surface of the impression cylinder 117, so that second-number printing is performed on the one surface.

The printing sheet W after the second-number printing performed on the one surface on the impression cylinder 117 then has the gripping of its leading edge changed to a gripper device of the transport cylinder 120 and the gripping of the leading edge is thereafter changed to a gripper device of the transport cylinder 122 of the first drying unit 121, so that the printing sheet W is held and transported on the transport cylinder 122 with the one surface facing outward.

In this transport operation, the drying lamps 123 heats and dries the one surface of the printing sheet W, on which the above-mentioned seal printing and first- and second-number printing have been performed and the coating processes by the coating units 126, 135 are yet to be performed.

Subsequently, the gripping of the leading edge of the printing sheet W is changed to a gripper device of the impression cylinder 127 of the other-surface coating unit 126, so that the printing sheet W is held and transported on the impression cylinder 127 this time with the other surface (back surface) facing outward.

As the printing sheet W passes between the impression cylinder 127 and the coating cylinder 128, a coating liquid such as varnish that has been applied in advance to the surface of the coating cylinder 128 from the anilox roller 129 and the chamber coater 130 is transferred onto the other surface of the printing sheet W, which is held and transported on the peripheral surface of the impression cylinder 127, so that a coating process is performed on the other surface.

The printing sheet W after the coating process performed on the other surface on the impression cylinder 127 then has the gripping of its leading edge changed to a gripper device of the transport cylinder 131 and the gripping of the leading edge is thereafter changed from the gripper device of this transport cylinder 131 to that of the transport cylinder 133 of the second drying unit 132, so that the printing sheet W is held and transported on the transport cylinder 133 with the other surface facing outward.

In this transport operation, the drying lamps 134 heats and dries the other surface of the printing sheet W, on this other surface which a coating process has been performed and the one surface of which a coating process is yet to be performed.

Subsequently, the gripping of the leading edge of the printing sheet W is changed to a gripper device of the impression cylinder 136 of the one-surface coating unit 135, so that the printing sheet W is held and transported on the impression cylinder 136 this time with the one surface facing outward.

As the printing sheet W passes between the impression cylinder 136 and the coating cylinder 137, a coating liquid such as varnish that has been applied in advance to the surface of the coating cylinder 137 from the anilox roller 138 and the chamber coater 139 is transferred onto the one surface of the printing sheet W, which is held and transported on the peripheral surface of the impression cylinder 136, so that a coating process is performed on the one surface.

The printing sheet W after the coating process performed on the one surface on the impression cylinder 136 then has its gripping changed to the gripper bars, not illustrated, of the transport chain 142 of the delivery unit 140 through the delivery cylinder 141, so that the printing sheet W is transported on the upper travelling chain portion of the transport chain 142 this time with the other surface facing outward.

The printing sheet W transported by the transport chain 142 has the one surface heated and dried by the drying lamps 145 while being guided and spread in a sucked state by the suction guide 144, before being stacked onto the pile board 143*a*, 143*b*.

Then, the printing sheet W is transported by the travel of the transport chain 142 and then released and stacked onto the pile board 143*a* or 143*b* with the one surface up, on which the above-mentioned seal printing and first- and second-number printing have been performed.

Here, as mentioned above, if a trouble occurs, for example, in the seal printing due to some reason while the seal printing, the number printing, and the coating processes are performed on printing sheets W, the seal inspecting device 50A outputs an NG signal for the seal printing to the printing-press control device 10 based on the image signal from the seal inspection camera 124A.

Figure 11:
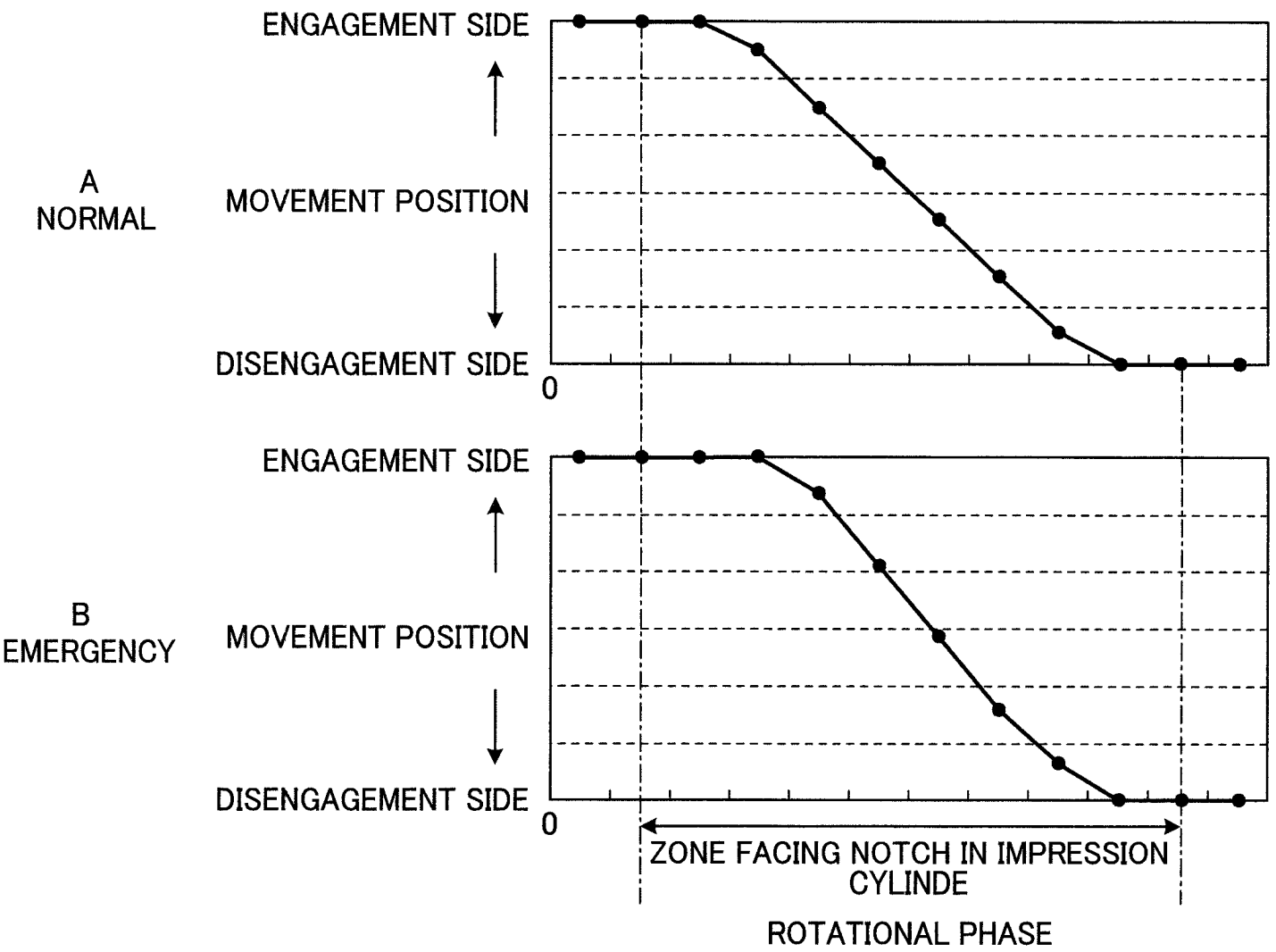
FIG. 11 is a set of graphs illustrating a normal cylinder engagement-disengagement shift curve (part A) and an emergency cylinder engagement-disengagement shift curve (part B) for the combined printing press in FIG. 1.

In response to this, the printing-press control device 10 outputs an emergency disengagement command for the seal printing that is based on an emergency cylinder engagement-disengagement shift curve (emergency cylinder movement timings: see part B of FIG. 11. The same applies below.) to the seal-cylinder throw-on and throw-off device 37. The printing-press control device 10 also outputs a normal disengagement command that is based on a normal cylinder engagement-disengagement shift curve (normal cylinder movement timings: see part A of FIG. 11. The same applies below.) to the engaging-disengaging devices other than the seal-cylinder throw-on and throw-off device 37 (first-number-cylinder throw-on and throw-off device 38, second-number-cylinder throw-on and throw-off device 39, other-surface-coating-cylinder throw-on and throw-off device 40, and one-surface-coating-cylinder throw-on and throw-off device 41).

Then, the printing-press control device 10 controls the actuation of the seal-cylinder throw-on and throw-off device 37 based on the emergency cylinder engagement-disengagement shift curve illustrated in part B of FIG. 11 so that emergency disengagement of the seal cylinder 108 will be performed at the rotational phase of the next notch in the impression cylinder 107 of the seal printing unit 106, that is, the rotational phase of the notch provided with the gripper device gripping the next printing sheet W following the printing sheet W on which the troubled seal printing has been performed. The printing-press control device 10 also controls the actuation of the engaging-disengaging devices 38 to 41 based on the normal cylinder engagement-disengagement shift curve illustrated in part A of FIG. 11 so that the cylinders 113, 118 will be disengaged at the rotational phases of the next (immediately following) notches in the impression cylinders 112, 117 of the printing units 111, 116, respectively, and so that the cylinders 128, 137 will be disengaged at the rotational phases of the notches in the impression cylinders 127, 136 of the coating units 126, 135 provided with the gripper devices gripping printing sheets W on which only the seal and the first number have been printed (printing sheets W on which the second number has not been printed).

Thereafter, the printing-press control device 10 controls the actuation of the inkjet device 147 to: print the mark "1" on the marginal regions on the printing sheet W printed at the first-number printing unit 111 at the time of occurrence of the trouble in the seal printing and the printing sheets W already printed at the first-number printing unit 111 before that printing sheet W but yet to be printed at the second-number printing unit 116 (e.g. four to seven printing sheets W preceding the printing sheet W on which the printing failure has occurred) ; print the mark "2" on the marginal regions on the printing sheets W already printed at the seal printing unit 106 before the printing sheet W with the printing failure, printed at the seal printing unit 106 at the time of occurrence of the above trouble, but yet to be printed at the first-number printing unit 111 (e.g. one to three printing sheets W preceding the printing sheet W on which the printing failure has occurred); and print the mark "3" on the marginal region on the printing sheet W on which the printing failure has occurred.

Thereafter, the printing-press control device 10 controls the actuation of the sheet feeder 101 to stop the feed of printing sheets W, and controls the actuation of the combined printing press 100 to stop the operation of the combined printing press 100 when all the printing sheets W in the units 106, 111, 116, 126, 135 are delivered to the delivery unit 140.

In sum, if a trouble occurs in the seal printing due to some reason, the printing sheet W printed at the second-number printing unit 116 at the time of occurrence of the trouble and printing sheets W already printed at the second-number printing unit 116 before that printing sheet W (e.g. eight or more printing sheets W preceding the printing sheet W on which the printing failure has occurred) are delivered to the pile board 143*a* or 143*b* for good sheets in a state where the seal printing, the first- and second-number printing, and the coating have all been done well. Also, the printing sheet W printed at the first-number printing unit 111 at the time of occurrence of the trouble and the printing sheets W already printed at the first-number printing unit 111 before that printing sheet S but yet to be printed at the second-number printing unit 116 are given the mark "1" by the inkjet device 147 and delivered to the pile board 143*c* for bad sheets in a state where the seal printing and the first-number printing have been done well but neither of the second-number printing and the coating has been done. Also, the printing sheets W already printed at the seal printing unit 106 before the printing sheet W with the printing failure, printed at the seal printing unit 106 at the time of occurrence of the above trouble, but yet to be printed at the first-number printing unit 111 are given the mark "2" by the inkjet device 147 and delivered to the pile board 143*c* for bad sheets in a state where the seal printing has been done well but none of the first- and second-number printing and the coating has been done. The printing sheet Won which the printing failure has occurred is given the mark "3" by the inkjet device 147 and delivered to the pile board 143*c* for bad sheets.

Also, if a trouble occurs, for example, in the first-number printing due to some reason, the first-number inspecting device 50B outputs an NG signal for the first-number printing to the printing-press control device 10 based on the image signal from the first-number inspection camera 124B.

In response to this, the printing-press control device outputs an emergency disengagement command for the first-number printing that is based on the emergency cylinder engagement-disengagement shift curve illustrated in part B of FIG. 11 to the first-number-cylinder throw-on and throw-off device 38. The printing-press control device 10 also outputs a normal disengagement command that is based on the normal cylinder engagement-disengagement shift curve illustrated in part A of FIG. 11 to the engaging-disengaging devices other than the first-number-cylinder throw-on and throw-off device 38 (seal-cylinder throw-on and throw-off device 37, second-number-cylinder throw-on and throw-off device 39, other-surface-coating-cylinder throw-on and throw-off device 40, and one-surface-coating-cylinder throw-on and throw-off device 41).

Then, the printing-press control device 10 controls the actuation of the first-number-cylinder throw-on and throw-off device 38 based on the emergency cylinder engagement-disengagement shift curve illustrated in part B of FIG. 11 so that emergency disengagement of the number cylinder 113 will be performed at the rotational phase of the next notch in the impression cylinder 112 of the first-number printing unit 111, that is, the rotational phase of the notch provided with the gripper device gripping the next printing sheet W following the printing sheet W on which the troubled first-number printing has been performed. The printing-press control device 10 also controls the actuation of the engaging-disengaging devices 37, 39 to 41 based on the normal cylinder engagement-disengagement shift curve illustrated in part A of FIG. 11 so that the cylinders 108, 118 will be disengaged at the rotational phases of the next (immediately following) notches in the impression cylinders 107, 117 of the printing units 106, 116, respectively, and so that the cylinders 128, 137 will be disengaged at the rotational phases of the notches in the impression cylinders 127, 136 of the coating units 126, 135 provided with the gripper devices gripping printing sheets W on which only the seal and the first number have been printed (printing sheets W on which the second number has not been printed).

Thereafter, the printing-press control device 10 controls the actuation of the inkjet device 147 to: print the mark "1" on the marginal regions on the printing sheets W already printed at the first-number printing unit 111 before the printing sheet W printed at the first-number printing unit 111 at the time of occurrence of the trouble in the first-number printing, but yet to be printed at the second-number printing unit 116 (e.g. one to three printing sheets W preceding the printing sheet W on which the printing failure has occurred); print the mark "3" on the marginal region on the printing sheet W on which the printing failure has occurred; and print the mark "2" on the marginal regions on the printing sheet W printed at the seal printing unit 106 at the time of occurrence of the above trouble and the printing sheets W already printed at the seal printing unit 106 before that printing sheet W but yet to be printed at the first-number printing unit 111 (e.g. one to four printing sheets W following the printing sheet W on which the printing failure has occurred).

Thereafter, the printing-press control device 10 controls the actuation of the combined printing press 100 to stop the operation of the combined printing press 100 in a manner similar to the above-mentioned case.

In sum, if a trouble occurs in the first-number printing due to some reason, the printing sheet W printed at the second-number printing unit 116 at the time of occurrence of the trouble and printing sheets W already printed at the second-number printing unit 116 before that printing sheet W (e.g. four or more printing sheets W preceding the printing sheet W on which the printing failure has occurred) are delivered to the pile board 143*a* or 143*b* for good sheets in a state where the seal printing, the first- and second-number printing, and the coating have all been done well. Also, the printing sheets W printed at the first-number printing unit 111 before the printing sheet W with the printing failure, printed at the first-number printing unit 111, but yet to be printed at the second-number printing unit 116 are given the mark "1" by the inkjet device 147 and delivered to the pile board 143*c* for bad sheets in a state where the seal printing and the first-number printing have been done well but neither of the second-number printing and the coating has been done. The printing sheet W on which the printing failure has occurred is given the mark "3" by the inkjet device 147 and delivered to the pile board 143*c* for bad sheets. Also, the printing sheet W printed at the seal printing unit 106 at the time of occurrence of the above trouble and the printing sheets W already printed at the seal printing unit 106 before that printing sheet W but yet to be printed at the first-number printing unit 111 are given the mark "2" by the inkjet device 147 and delivered to the pile board 143*c* for bad sheets in a state where the seal printing has been done well but none of the first- and second-number printing and the coating has been done.

Also, if a trouble occurs, for example, in the second-number printing due to some reason, the second-number inspecting device 50C outputs an NG signal for the second-number printing to the printing-press control device 10 based on the image signal from the second-number inspection camera 124C.

In response to this, the printing-press control device 10 outputs an emergency disengagement command for the second-number printing that is based on the emergency cylinder engagement-disengagement shift curve illustrated in part B of FIG. 11 to the second-number-cylinder throw-on and throw-off device 39. The printing-press control device 10 also outputs a normal disengagement command that is based on the normal cylinder engagement-disengagement shift curve illustrated in part A of FIG. 11 to the engaging-disengaging devices other than the second-number-cylinder throw-on and throw-off device 39 (seal-cylinder throw-on and throw-off device 37, first-number-cylinder throw-on and throw-off device 38, other-surface-coating-cylinder throw-on and throw-off device 40, and one-surface-coating-cylinder throw-on and throw-off device 41).

Then, the printing-press control device 10 controls the actuation of the second-number-cylinder throw-on and throw-off device 39 based on the emergency cylinder engagement-disengagement shift curve illustrated in part B of FIG. 11 so that emergency disengagement of the number cylinder 118 will be performed at the rotational phase of the next notch in the impression cylinder 117 of the second-number printing unit 116, that is, the rotational phase of the notch provided with the gripper device gripping the next printing sheet W following the printing sheet W on which the troubled second-number printing has been performed. The printing-press control device 10 also controls the actuation of the engaging-disengaging devices 37, 38, 40, 41 based on the normal cylinder engagement-disengagement shift curve illustrated in part A of FIG. 11 so that the cylinders 108, 113 will be disengaged at the rotational phases of the next (immediately following) notches in the impression cylinders 107, 112 of the printing units 106, 111, respectively, and so that the cylinders 128, 137 will be disengaged at the rotational phases of the notches in the impression cylinders 127, 136 of the coating units 126, 135 provided with the gripper devices gripping printing sheets W on which only the seal and the first number have been printed (printing sheets W on which the second number has not been printed).

Thereafter, the printing-press control device 10 controls the actuation of the inkjet device 147 to: print the mark "3" on the marginal region on the printing sheet W on which the printing failure has occurred; print the mark "1" on the marginal regions on the printing sheet W printed at the first-number printing unit 111 at the time of occurrence of the trouble in the second-number printing and the printing sheets W already printed at the first-number printing unit 111 before that printing sheet W but yet to be printed at the second-number printing unit 116 (e.g. one to four printing sheets W following the printing sheet W on which the printing failure has occurred); and print the mark "2" on the marginal regions on the printing sheet W printed at the seal printing unit 106 at the time of occurrence of the above trouble and the printing sheets W already printed at the seal printing unit 106 before that printing sheet W but yet to be printed at the first-number printing unit 111 (e.g. five to eight printing sheets W preceding the printing sheet W on which the printing failure has occurred).

Thereafter, the printing-press control device 10 controls the actuation of the combined printing press 100 to stop the operation of the combined printing press 100 in a manner similar to the above-mentioned case.

In sum, if a trouble occurs in the second-number printing due to some reason, the print sheet (s) W already printed at the second-number printing unit 116 before the printing sheet W printed at the second-number printing unit 116 at the time of occurrence of the trouble (e.g. one or more printing sheets W preceding the printing sheet W on which the printing failure has occurred) is delivered to the pile board 143*a* or 143*b* for good sheets in a state where the seal printing, the first- and second-number printing, and the coating have all been done well. The printing sheet W on which the printing failure has occurred is given the mark "3" by the inkjet device 147 and delivered to the pile board 143*c* for bad sheets. Also, the printing sheet W printed at the first-number printing unit 111 at the time of occurrence of the above trouble and the printing sheets W already printed at the first-number printing unit 111 before that printing sheet W but yet to be printed at the second-number printing unit 116 are given the mark "1" by the inkjet device 147 and delivered to the pile board 143*c* for bad sheets in a state where the seal printing and the first-number printing have been done well but neither of the second-number printing and the coating has been done. Also, the printing sheet W printed at the seal printing unit 106 at the time of occurrence of the above trouble and the printing sheets W already printed at the seal printing unit 106 before that printing sheet W but yet to be printed at the first-number printing unit 111 are given the mark "2" by the inkjet device 147 and delivered to the pile board 143*c* for bad sheets in a state where the seal printing has been done well but none of the first- and second-number printing and the coating has been done.

As described above, if a trouble occurs in the seal printing, the first-number printing, or the second-number printing, the operation of the combined printing press 100 is suspended, and the printing sheet W given the mark "3", on which the printing failure has occurred, is discarded whereas the printing sheets W given the marks "1" or "2" are placed on the pile board of the sheet feeder 101 again, and the printing is resumed.

Here, the printing-press control device 10 determines based on the signal from the mark detection camera 146 whether a mark is present or not and, if a mark is present, whether that mark is "1" or "2". If the mark "1" is given on the printing sheet W, this printing sheet W is in a state where the seal printing and the first-number printing have been done well but neither of the second-number printing and the coating has been done yet, as mentioned above. Thus, the printing-press control device 10 controls the actuation of the engaging-disengaging devices 37 to 41 to skip the seal printing and the first-number printing and perform only the second-number printing and the coating.

Also, if the mark "2" is given on the printing sheet W, this printing sheet W is in a state where the seal printing has been done well but none of the first- and second-number printing and the coating has been done yet, as mentioned above. Thus, the printing-press control device 10 controls the actuation of the engaging-disengaging devices 37 to 41 based on the signal from the mark detection camera 146 to skip the seal printing and perform only the first-number printing, the second-number printing, and the coating.

Meanwhile, the printing-press control device 10 performs the regular control if no mark is given on the printing sheet W.

Now, processing by the printing-press control device 10 for achieving the above-described finding of a printing trouble and reduction of wasted paper will be described in detail through operation procedures illustrated in FIG. 5A to FIG. 5C, FIG. 6A to FIG. 6D, FIG. 7A to FIG. 7D, FIG. 8A to FIG. 8D, and FIG. 9A to FIG. 9B.

[Basic Procedure]

First, in the printing-press control device 10, in step S1, it is determined whether or not the printing start switch 26 is on. If the printing start switch 26 is off (NO), the processing returns to the process of step S1. On the other hand, if the printing start switch 26 is on (YES), then in step S2, a printing speed in the printing-speed storage memory M11 is read.

In step S3 after step S2, the printing speed is outputted to the drive-motor driver 33 through the D-A converter 32. In step S4, a reset signal is outputted to the printing-press rotation-count counter 30 to reset the printing-press rotation-count counter 30. Then in step S5, a sheet-feed start command is outputted to the sheet feeder 101 to start sheet feed.

Thereafter in step S6, the count value of the printing-press rotation-count counter 30 is read, and this count value is stored in the printing-press-rotation-count-counter count-value storage memory M12. In step S7, a mark-detection start rotation count is read from the mark detection start rotation-count storage memory M13.

Thereafter in step S8, it is determined whether or not the count value of the printing-press rotation-count counter 30 is greater than or equal to the mark detection start rotation count. If the count value of the printing-press rotation-count counter 30 is less than the mark detection start rotation count (NO), the processing returns to the above-described step S6. On the other hand, if the count value of the printing-press rotation-count counter 30 is greater than or equal to the mark detection start rotation count (YES), then in step S9, the count value of the printing-press rotational-phase detection counter 36 is read and this count value is stored in the printing-press-rotational-phase-detection-counter count-value storage memory M14.

In step S10 after step S9, the rotational phase of the combined printing press 100 is calculated from the count value of the printing-press rotational-phase detection counter 36, and the calculation result is stored in the printing-press rotational-phase storage memory M15. In step S11, a mark detection rotational phase in the mark detection rotational-phase storage memory M16 is read.

Thereafter in step S12, it is determined whether or not the rotational phase of the combined printing press 100 is equal to the mark detection rotational phase. If the rotational phase of the combined printing press 100 is different from the mark detection rotational phase (NO), the processing proceeds to step S26 to be described later. On the other hand, if the rotational phase of the combined printing press 100 is equal to the mark detection rotational phase (YES), then in step S13, an imaging command is outputted to the mark detection camera 146, and imaging with the mark detection camera 146 is performed.

Specifically, the rotation count and the rotational phase of the combined printing press 100 at the point when a printing sheet W reaches the imaging position of the mark detection camera 146 after starting to be fed by the sheet feeder 101 are known in advance. Thus, the printing-press rotation-count counter 30 is reset when the sheet feeder 101 starts sheet feed, and imaging with the mark detection camera 146 is performed when the printing sheet W reaches a predetermined position.

In step S14 after step S13, the captured image data is read from the mark detection camera 146, and this capture image data is stored in the captured-image-data storage memory M17. In step S15, using a pattern matching method, the captured image data is compared with reference data of each of marks read from the mark-1 reference-data storage memory M18 and the mark-2 reference-data storage memory M19 to identify the mark.

Thereafter in step S16, it is determined whether or not the mark identified in step S15 is 1. If the mark is not 1 (NO), the processing proceeds to step S22, in which it is determined whether or not the mark identified in step S15 is 2. On the other hand, if the mark is 1 (YES), the processing proceeds to step S17 to be described later.

Also, if the mark is not 2 in step S22 (NO), then in step S26, the count value of the printing-press rotation-count counter 30 is read and this count value is stored in the printing-press-rotation-count-counter count-value storage memory M12. On the other hand, if the mark is 2 (YES), the processing proceeds to step S23 to be described later.

In step S27 after the step S26, a seal-cylinder engagement rotation count in the seal-cylinder engagement rotation-count storage memory M22 is read. Thereafter in step S28, it is determined whether or not the count value of the printing-press rotation-count counter 30 is greater than or equal to the seal-cylinder engagement rotation count. If the count value of the printing-press rotation-count counter 30 is less than the seal-cylinder engagement rotation count (NO), the processing returns to the above-described step S6. On the other hand, if the count value of the printing-press rotation-count counter 30 is greater than or equal to the seal-cylinder engagement rotation count (YES), then in step S29, the count value of the printing-press rotational-phase detection counter 36 is read and this count value is stored in the printing-press-rotational-phase-detection-counter count-value storage memory M14.

In step S30 after step S29, the rotational phase of the combined printing press 100 is calculated from the count value of the printing-press rotational-phase detection counter 36, and the calculation result is stored in the printing-press rotational-phase storage memory M15. In step S31, a seal-cylinder engagement/disengagement rotational phase in the seal-cylinder engagement/disengagement rotational-phase storage memory M23 is read.

Thereafter in step S32, it is determined whether or not the rotational phase of the combined printing press 100 is equal to the seal-cylinder engagement/disengagement rotational phase. If the rotational phase of the combined printing press 100 is different from the seal-cylinder engagement/disengagement rotational phase (NO), the processing proceeds to step S42 to be described later. On the other hand, if the rotational phase of the combined printing press 100 is equal to the seal-cylinder engagement/disengagement rotational phase (YES), then in step S33, the count value of the printing-press rotation-count counter 30 is read and stored in the printing-press-rotation-count-counter count-value storage memory M12.

In step S34 after step S33, the smallest seal-cylinder disengagement rotation count in the first address position in the seal-cylinder disengagement timing storage memory M20 is read.

Thereafter in step S35, it is determined whether or not the count value of the printing-press rotation-count counter 30 is equal to the smallest seal-cylinder disengagement rotation count. If the count value of the printing-press rotation-count counter 30 is different from the smallest seal-cylinder disengagement rotation count (NO), then in step S40, it is determined whether or not the output of the seal-cylinder disengaged-state detector 43 is on, that is, whether or not the seal cylinder 108 is in a disengaged state. On the other hand, if the count value of the printing-press rotation-count counter 30 is equal to the smallest seal-cylinder disengagement rotation count (YES), the processing proceeds to step S36 to be described later.

If the output of the seal-cylinder disengaged-state detector 43 is on in step S40 (YES), then in step S41, an engagement signal is outputted to the seal-cylinder throw-on and throw-off device 37 to bring the seal cylinder 108 into contact with the impression cylinder 107. In step S42, the count value of the printing-press rotation-count counter 30 is read and this count value is stored in the printing-press-rotation-count-counter count-value storage memory M12. On the other hand, if the output of the seal-cylinder disengaged-state detector 43 is off (NO), the processing proceeds to the process of the above-described step S42.

In step S43 after step S42, a seal inspection start rotation count in the seal inspection start rotation-count storage memory M24 is read. Thereafter in step S44, it is determined whether or not the count value of the printing-press rotation-count counter 30 is greater than or equal to the seal inspection start rotation count. If the count value of the printing-press rotation-count counter 30 is less than the seal inspection start rotation count (NO), the processing returns to the above-described step S6. On the other hand, if the count value of the printing-press rotation-count counter 30 is greater than or equal to the seal inspection start rotation count (YES), then in step S45, the count value of the printing-press rotational-phase detection counter 36 is read and this count value is stored in the printing-press-rotational-phase-detection-counter count-value storage memory M14.

In step S46 after step S45, the rotational phase of the combined printing press 100 is calculated from the count value of the printing-press rotational-phase detection counter 36, and the calculation result is stored in the printing-press rotational-phase storage memory M15. In step S47, a seal inspection rotational phase in the seal inspection rotational-phase storage memory M25 is read.

Thereafter in step S48, it is determined whether or not the rotational phase of the combined printing press 100 is equal to the seal inspection rotational phase. If the rotational phase of the combined printing press 100 is different from the seal inspection rotational phase (NO), the processing proceeds to step S50 to be described next. On the other hand, if the rotational phase of the combined printing press 100 is equal to the seal inspection rotational phase (YES), an inspection command is outputted to the seal inspecting device 50A in step S49, and the processing proceeds to step S50 to be described next. As a result, the seal inspecting device 50A performs a seal printing inspection to be described later.

In step S50, it is determined whether or not an NG signal is outputted from the seal inspecting device 50A. If an NG signal is not outputted from the seal inspecting device 50A (NO), then in step S70, the count value of the printing-press rotation-count counter 30 is read and this count value is stored in the printing-press-rotation-count-counter count-value storage memory M12. On the other hand, an NG signal is outputted from the seal inspecting device 50A (YES), the processing proceeds to step S51 to be described later.

In step S71 after step S70, a first-number-cylinder engagement rotation count in the first-number-cylinder engagement rotation-count storage memory M29 is read.

Thereafter in step S72, it is determined whether or not the count value of the printing-press rotation-count counter 30 is greater than or equal to the first-number-cylinder engagement rotation count. If the count value of the printing-press rotation-count counter 30 is less than the first-number-cylinder engagement rotation count (NO), the processing returns to the above-described step S6. On the other hand, if the count value of the printing-press rotation-count counter 30 is greater than or equal to the first-number-cylinder engagement rotation count (YES), then in step S73, the count value of the printing-press rotational-phase detection counter 36 is read and this count value is stored in the printing-press-rotational-phase-detection-counter count-value storage memory M14.

In step S74 after step S73, the rotational phase of the combined printing press 100 is calculated from the count value of the printing-press rotational-phase detection counter 36, and the calculation result is stored in the printing-press rotational-phase storage memory M15. In step S75, a first-number-cylinder engagement/disengagement rotational phase in the first-number-cylinder engagement/disengagement rotational-phase storage memory M30 is read.

Thereafter in step S76, it is determined whether or not the rotational phase of the combined printing press 100 is equal to the first-number-cylinder engagement/disengagement rotational phase. If the rotational phase of the combined printing press 100 is different from the first-number-cylinder engagement/disengagement rotational phase (NO), the processing proceeds to step S86 to be described later. On the other hand, if the rotational phase of the combined printing press 100 is equal to the first-number-cylinder engagement/disengagement rotational phase (YES), then in step S77, the count value of the printing-press rotation-count counter 30 is read and this count value is stored in the printing-press-rotation-count-counter count-value storage memory M12.

In step S78 after step S77, the smallest first-number-cylinder disengagement rotation count in the first address position in the first-number-cylinder disengagement timing storage memory M21 is read.

Thereafter in step S79, it is determined whether or not the count value of the printing-press rotation-count counter 30 is equal to the smallest first-number-cylinder disengagement rotation count. If the count value of the printing-press rotation-count counter 30 is different from the smallest first-number-cylinder disengagement rotation count (NO), then in step S84, it is determined whether or not the output of the first-number-cylinder disengaged-state detector 45 is on, that is, whether or not the first-number cylinder 113 is in a disengaged state. On the other hand, if the count value of the printing-press rotation-count counter 30 is equal to the smallest first-number-cylinder disengagement rotation count (YES), the processing proceeds to step S80 to be described later.

If the output of the first-number-cylinder disengaged-state detector 45 is on in step S84 (YES), then in step S85, an engagement signal is outputted to the first-number-cylinder throw-on and throw-off device 38 to bring the first-number cylinder 113 into contact with the impression cylinder 112. In step S86, the count value of the printing-press rotation-count counter 30 is read and this count value is stored in the printing-press-rotation-count-counter count-value storage memory M12. On the other hand, if the output of the first-number-cylinder disengaged-state detector 45 is off (NO), the processing proceeds to the above-described step S86.

In step S87 after step S86, a first-number inspection start rotation count in the first-number inspection start rotation-count storage memory M31 is read. Thereafter in step S88, it is determined whether or not the count value of the printing-press rotation-count counter 30 is greater than or equal to the first-number inspection start rotation count. If the count value of the printing-press rotation-count counter 30 is less than the first-number inspection start rotation count (NO), the processing returns to the above-described step S6. On the other hand, if the count value of the printing-press rotation-count counter 30 is greater than or equal to the first-number inspection start rotation count (YES), then in step S89, the count value of the printing-press rotational-phase detection counter 36 is read and this count value is stored in the printing-press-rotational-phase-detection-counter count-value storage memory M14.

In step S90 after step S89, the rotational phase of the combined printing press 100 is calculated from the count value of the printing-press rotational-phase detection counter 36, and the calculation result is stored in the printing-press rotational-phase storage memory M15. In step S91, a first-number inspection rotational phase in the first-number inspection rotational-phase storage memory M32 is read.

Thereafter in step S92, it is determined whether or not the rotational phase of the combined printing press 100 is equal to the first-number inspection rotational phase. If the rotational phase of the combined printing press 100 is different from the first-number inspection rotational phase (NO), the processing proceeds to step S94 to be described next. On the other hand, if the rotational phase of the combined printing press 100 is equal to the first-number inspection rotational phase (YES), an inspection command is outputted to the first-number inspecting device 50B in step S93, and the processing proceeds to step S94 to be described next. As a result, the first-number inspecting device SOB performs a first-number printing inspection to be described later.

In step S94, it is determined whether or not an NG signal is outputted from the first-number inspecting device 50B. If an NG signal is not outputted from the first-number inspecting device 50B (NO), then in step S114, the count value of the printing-press rotation-count counter 30 is read and this count value is stored in the printing-press-rotation-count-counter count-value storage memory M12. On the other hand, if an NG signal is outputted from the first-number inspecting device 50B (YES), the processing proceeds to step S95 to be described later.

In step S115 after step S114, a second-number-cylinder engagement rotation count in the second-number-cylinder engagement rotation-count storage memory M33 is read.

Thereafter in step S116, it is determined whether or not the count value of the printing-press rotation-count counter 30 is greater than or equal to the second-number-cylinder engagement rotation count. If the count value of the printing-press rotation-count counter 30 is less than the second-number-cylinder engagement rotation count (NO), the processing returns to the above-described step S6. On the other hand, if the count value of the printing-press rotation-count counter 30 is greater than or equal to the second-number-cylinder engagement rotation count (YES), then in step S117, the count value of the printing-press rotational-phase detection counter 36 is read and this count value is stored in the printing-press-rotational-phase-detection-counter count-value storage memory M14.

In step S118 after step S117, the rotational phase of the combined printing press 100 is calculated from the count value of the printing-press rotational-phase detection counter 36, and the calculation result is stored in the printing-press rotational-phase storage memory M15. In step S119, a second-number-cylinder engagement/disengagement rotational phase in the second-number-cylinder engagement/disengagement rotational-phase storage memory M34 is read.

Thereafter in step S120, it is determined whether or not the rotational phase of the combined printing press 100 is equal to the second-number-cylinder engagement/disengagement rotational phase. If the rotational phase of the combined printing press 100 is different from the second-number-cylinder engagement/disengagement rotational phase (NO), the processing proceeds to step S122 to be described next. On the other hand, if the rotational phase of the combined printing press 100 is equal to the second-number-cylinder engagement/disengagement rotational phase (YES), an engagement signal is outputted to the second-number-cylinder throw-on and throw-off device 39 to bring the second-number cylinder 118 into contact with the impression cylinder 117 in step S121, and the processing proceeds to step S122 to be described next.

In step S122, the count value of the printing-press rotation-count counter 30 is read and this count value is stored in the printing-press-rotation-count-counter count-value storage memory M12. Thereafter in step S123, a second-number inspection start rotation count in the second-number inspection start rotation-count storage memory M35 is read.

In step S124 after step S123, it is determined whether or not the count value of the printing-press rotation-count counter 30 is greater than or equal to the second-number inspection start rotation count. If the count value of the printing-press rotation-count counter 30 is less than the second-number inspection start rotation count (NO), the processing returns to the above-described step S6. On the other hand, if the count value of the printing-press rotation-count counter 30 is greater than or equal to the second-number inspection start rotation count (YES), then in step S125, the count value of the printing-press rotational-phase detection counter 36 is read and this count value is stored in the printing-press-rotational-phase-detection-counter count-value storage memory M14.

In step S126 after step S125, the rotational phase of the combined printing press 100 is calculated from the count value of the printing-press rotational-phase detection counter 36, and the calculation result is stored in the printing-press rotational-phase storage memory M15. In step S127, a second-number inspection rotational phase in the second-number inspection rotational-phase storage memory M36 is read.

Thereafter instep S128, it is determined whether or not the rotational phase of the combined printing press 100 is equal to the second-number inspection rotational phase. If the rotational phase of the combined printing press 100 is different from the second-number inspection rotational phase (NO), the processing proceeds to step S130 to be described next. On the other hand, if the rotational phase of the combined printing press 100 is equal to the second-number inspection rotational phase (YES), an inspection command is outputted to the second-number inspecting device 50C in step S129, and the processing proceeds to step S130 to be described next. As a result, the second-number inspecting device 50C performs a second-number printing inspection to be described later.

In step S130, it is determined whether or not an NG signal is outputted from the second-number inspecting device 50C. If an NG signal is not outputted from the second-number inspecting device 50C (NO), then in step S150, the count value of the printing-press rotation-count counter 30 is read and this count value is stored in the printing-press-rotation-count-counter count-value storage memory M12. On the other hand, if an NG signal is outputted from the second-number inspecting device 50C (YES), the processing proceeds to step S131 to be described later.

In step S151 after step S150, an other-surface-coating-cylinder engagement rotation count in the other-surface-coating-cylinder engagement rotation-count storage memory M37 is read.

Thereafter in step S152, it is determined whether or not the count value of the printing-press rotation-count counter 30 is greater than or equal to the other-surface-coating-cylinder engagement rotation count. If the count value of the printing-press rotation-count counter 30 is less than the other-surface-coating-cylinder engagement rotation count (NO), the processing returns to the above-described step S6. On the other hand, if the count value of the printing-press rotation-count counter 30 is greater than or equal to the other-surface-coating-cylinder engagement rotation count (YES), then in step S153, the count value of the printing-press rotational-phase detection counter 36 is read and this count value is stored in the printing-press-rotational-phase-detection-counter count-value storage memory M14.

In step S154 after step S153, the rotational phase of the combined printing press 100 is calculated from the count value of the printing-press rotational-phase detection counter 36, and the calculation result is stored in the printing-press rotational-phase storage memory M15. In step S155, an other-surface-coating-cylinder engagement/disengagement rotational phase in the other-surface-coating-cylinder engagement/disengagement rotational-phase storage memory M38 is read.

Thereafter instep S156, it is determined whether or not the rotational phase of the combined printing press 100 is equal to the other-surface-coating-cylinder engagement/disengagement rotational phase. If the rotational phase of the combined printing press 100 is different from the other-surface-coating-cylinder engagement/disengagement rotational phase (NO), the processing proceeds to step S158. On the other hand, if the rotational phase of the combined printing press 100 is equal to the other-surface-coating-cylinder engagement/disengagement rotational phase (YES), then in step S157, an engagement signal is outputted to the other-surface-coating-cylinder throw-on and throw-off device 40 to bring the other-surface coating cylinder 128 into contact with the impression cylinder 127. In step S158, the count value of the printing-press rotation-count counter 30 is read and this count value is stored in the printing-press-rotation-count-counter count-value storage memory M12.

In step S159 after step S158, a one-surface-coating-cylinder engagement rotation count in the one-surface-coating-cylinder engagement rotation-count storage memory M39 is read.

Thereafter instep S160, it is determined whether or not the count value of the printing-press rotation-count counter 30 is greater than or equal to the one-surface-coating-cylinder engagement rotation count. If the count value of the printing-press rotation-count counter 30 is less than the one-surface-coating-cylinder engagement rotation count (NO), the processing returns to the above-described step S6. On the other hand, if the count value of the printing-press rotation-count counter 30 is greater than or equal to the one-surface-coating-cylinder engagement rotation count (YES), then in step S161, the count value of the printing-press rotational-phase detection counter 36 is read and this count value is stored in the printing-press-rotational-phase-detection-counter count-value storage memory M14.

In step S162 after step S161, the rotational phase of the combined printing press 100 is calculated from the count value of the printing-press rotational-phase detection counter 36, and the calculation result is stored in the printing-press rotational-phase storage memory M15. In step S163, a one-surface-coating-cylinder engagement/disengagement rotational phase in the one-surface-coating-cylinder engagement/disengagement rotational-phase storage memory M40 is read.

Thereafter in step S164, it is determined whether or not the rotational phase of the combined printing press 100 is equal to the one-surface-coating-cylinder engagement/disengagement rotational phase. If the rotational phase of the combined printing press 100 is different from the one-surface-coating-cylinder engagement/disengagement rotational phase (NO), the processing returns to the above-described step S6. On the other hand, if the rotational phase of the combined printing press 100 is equal to the one-surface-coating-cylinder engagement/disengagement rotational phase (YES), an engagement signal is outputted to the one-surface-coating-cylinder throw-on and throw-off device 41 to bring the one-surface coating cylinder 137 into contact with the impression cylinder 136 in step S165, and the processing returns to the above-described step S6.

[Processing in Case where Trouble Occurs in Seal Printing]

In the basic procedure discussed above, if a trouble occurs in the seal printing due to some reason, an NG signal is outputted from the seal inspecting device 50A. Thus, the processing proceeds from the above-described step S50 to step S51, in which an emergency disengagement command for the seal printing that is based on the emergency cylinder engagement-disengagement shift curve illustrated in part B of FIG. 11 is outputted to the seal-cylinder throw-on and throw-off device 37, and also a sheet-feed stop command is outputted to the sheet feeder 101 to stop feeding new printing sheet W. As a result, emergency disengagement of the seal cylinder 108 is performed at the rotational phase of the next notch in the impression cylinder 107 of the seal printing unit 106, thereby suspending the seal printing.

In step S52 after step S51, a normal disengagement command that is based on the normal cylinder engagement-disengagement shift curve illustrated in part A of FIG. 11 is outputted to the engaging-disengaging devices other than the seal-cylinder throw-on and throw-off device, such as the first-number-cylinder throw-on and throw-off device 38, the second-number-cylinder throw-on and throw-off device 39, the other-surface-coating-cylinder throw-on and throw-off device 40, and the one-surface-coating-cylinder throw-on and throw-off device 41. As a result, the first-number cylinder 113 and the second-number cylinder 118 are disengaged at the rotational phases of the next (immediately following) notches in the impression cylinders 112, 117 of the printing units 111, 116, so that the first-number printing and the second-number printing are suspended, respectively. Also, the other-surface coating cylinder 128 and the one-surface coating cylinder 137 are disengaged after performing respectively the other-surface coating and the one-surface coating on the printing sheet W printed at the second-number printing unit 116 at the time of occurrence of the trouble in the seal printing and printing sheets W already printed at the second-number printing unit 116 before that printing sheet W.

Thereafter in step S53, the count value of the printing-press rotation-count counter 30 is read and this count value is stored in the printing-press-rotation-count-counter count-value storage memory M12.

Thereafter in step S54, inkjet actuation rotation counts are calculated by adding values of 15 to 18 (the numbers of rotations of the combined printing press 100 taken before the inkjet device 147 is reached by the printing sheet W printed at the first-number printing unit 111 at the time of occurrence of the trouble in the seal printing and the printing sheets W already printed at the first-number printing unit 111 before that printing sheet W but yet to be printed at the second-number printing unit 116) to the count value of the printing-press rotation-count counter 30. These inkjet actuation rotation counts are stored at the first to fourth address positions in the inkjet actuation rotation-count storage memory M26 together with the mark "1 (=disengaging the seal cylinder and the first-number cylinder)".

Thereafter in step S55, inkjet actuation rotation counts are calculated by adding values of 19 to 21 (the numbers of rotations of the combined printing press 100 taken before the inkjet device 147 is reached by the printing sheets W already printed at the seal printing unit 106 before the printing sheet W with the printing failure, printed at the seal printing unit 106 at the time of the trouble in the seal printing, but yet to be printed at the first-number printing unit 111) to the count value of the printing-press rotation-count counter 30. These inkjet actuation rotation counts are stored at the fifth to seventh address positions in the inkjet actuation rotation-count storage memory M26 together with the mark "2 (=disengaging the seal cylinder)".

Thereafter in step S56, an inkjet actuation rotation count is calculated by adding a value of 22 (the number of times the combined printing press 100 is rotated before the inkjet device 147 is reached by the printing sheet W on which the printing failure has occurred) to the count value of the printing-press rotation-count counter 30. This inkjet actuation rotation count is stored at the eighth address position in the inkjet actuation rotation-count storage memory M26 together with the mark "3 (=waste paper)".

Thereafter in step S57, a printing-press stop rotation count is calculated by adding a value of 35 (the number of times the combined printing press 100 is rotated before all the print sheets W in the combined printing press 100 are delivered to the delivery unit 140) to the count value of the printing-press rotation-count counter 30. This printing-press stop rotation count is stored in the printing-press stop rotation-count storage memory M27.

Thereafter in step S58, a value of 1 is written to the count-value-N storage memory M28. In step S59, the count value of the printing-press rotation-count counter 30 is read and this count value is stored in the printing-press-rotation-count-counter count-value storage memory M12. In step S60, the inkjet actuation rotation count at the N-th address position in the inkjet actuation rotation-count storage memory M26 is read.

Thereafter in step S61, it is determined whether or not the count value of the printing-press rotation-count counter 30 is equal to the inkjet actuation rotation count at the N-th address position in the inkjet actuation rotation-count storage memory M26. If the count value of the printing-press rotation-count counter 30 is different from the inkjet actuation rotation count at the N-th address position in the inkjet actuation rotation-count storage memory M26 (NO), the processing returns to the above-described step S59. On the other hand, if the count value of the printing-press rotation-count counter 30 is equal to the inkjet actuation rotation count at the N-th address position in the inkjet actuation rotation-count storage memory M26 (YES), then in step S62, the mark ("1", "2", or "3") at the N-th address position in the inkjet actuation rotation-count storage memory M26 is read.

In step S63 after step S62, a mark ("1", "2", or "3") ejection command is outputted to the inkjet device 147. As a result, a mark reflecting the printing condition is printed on the marginal region of the printing sheet W based on the contents set in the above-described steps S54, S55, S56.

Thereafter in step S64, a value of 1 is added to the count value N and the count-value-N storage memory M28 is overwritten with it. In step S65, it is determined whether or not the count value N is 9. If the count value N is not 9 (NO), the printing of marks by the inkjet device 147 has not yet been finished, and thus the processing returns to the above-described step S59. On the other hand, if the count value N is 9 (YES), the printing of marks by the inkjet device 147 has been finished, and thus in step S66, the count value of the printing-press rotation-count counter 30 is read and this count value is stored in the printing-press-rotation-count-counter count-value storage memory M12.

In step S67 after step S66, the printing-press stop rotation count in the printing-press stop rotation-count storage memory M27 is read.

Thereafter in step S68, it is determined whether or not the count value of the printing-press rotation-count counter 30 is equal to the printing-press stop rotation count. If the count value of the printing-press rotation-count counter 30 is different from the printing-press stop rotation count (NO), the processing returns to the above-described step S66. On the other hand, if the count value of the printing-press rotation-count counter 30 is equal to the printing-press stop rotation count (YES), then in step S69, a stop command is outputted to the drive-motor driver 33 to stop the combined printing press 100. The processing then returns to the above-described step S1 and waits until the printing start switch 26 is turned on.

[Processing in Case where Trouble Occurs in First-Number Printing]

Also, if a trouble occurs in the first-number printing due to some reason, an NG signal is outputted from the first-number inspecting device 50B. Thus, the processing proceeds from the above-described step S94 to step S95, in which an emergency disengagement command for the first-number printing that is based on the emergency cylinder engagement-disengagement shift curve illustrated in part B of FIG. 11 is outputted to the first-number-cylinder throw-on and throw-off device 38, and also a sheet-feed stop command is outputted to the sheet feeder 101 to stop feeding new printing sheet W. As a result, emergency disengagement of the first-number cylinder 113 is performed at the rotational phase of the next notch in the impression cylinder 112 of the first-number printing unit 111, thereby suspending the first-number printing.

In step S96 after step S95, a normal disengagement command that is based on the normal cylinder engagement-disengagement shift curve illustrated in part A of FIG. 11 is outputted to the engaging-disengaging devices other than the first-number-cylinder throw-on and throw-off device, such as the seal-cylinder throw-on and throw-off device 37, the second-number-cylinder throw-on and throw-off device 39, the other-surface-coating-cylinder throw-on and throw-off device 40, and the one-surface-coating-cylinder throw-on and throw-off device 41. As a result, the seal cylinder 108 and the second-number cylinder 118 are disengaged at the rotational phases of the next (immediately following) notches in the impression cylinders 107, 117 of the printing units 106, 116, so that the seal printing and the second-number printing are suspended, respectively. Also, the other-surface coating cylinder 128 and the one-surface coating cylinder 137 are disengaged after performing respectively the other-surface coating and the one-surface coating on the printing sheet W printed at the second-number printing unit 116 at the time of occurrence of the trouble in the seal printing and printing sheets W already printed at the second-number printing unit 116 before that printing sheet W.

Thereafter in step S97, the count value of the printing-press rotation-count counter 30 is read and this count value is stored in the printing-press-rotation-count-counter count-value storage memory M12.

Thereafter in step S98, inkjet actuation rotation counts are calculated by adding values of 15 to 17 (the numbers of rotations of the combined printing press 100 taken before the inkjet device 147 is reached by the printing sheets W already printed at the first-number printing unit 111 before the printing sheet W with the printing failure, printed at the first-number printing unit 111 at the time of the trouble in the first-number printing, but yet to be printed at the second-number printing unit 116) to the count value of the printing-press rotation-count counter 30. These inkjet actuation rotation counts are stored at the first to third address positions in the inkjet actuation rotation-count storage memory M26 together with the mark "1 (=disengaging the seal cylinder and the first-number cylinder)".

Thereafter in step S99, an inkjet actuation rotation count is calculated by adding a value of 18 (the number of times the combined printing press 100 is rotated before the inkjet device 147 is reached by the printing sheet W on which the printing failure has occurred) to the count value of the printing-press rotation-count counter 30. This inkjet actuation rotation count is stored at the fourth address position in the inkjet actuation rotation-count storage memory M26 together with the mark "3 (=waste paper)".

Thereafter in step S100, inkjet actuation rotation counts are calculated by adding values of 19 to 22 (the numbers of rotations of the combined printing press 100 taken before the inkjet device 147 is reached by the printing sheet W printed at the seal printing unit 106 at the time of occurrence of the trouble in the first-number printing and the printing sheets W already printed at the seal printing unit 106 before that printing sheet W but yet to be printed at the first-number printing unit 111) to the count value of the printing-press rotation-count counter 30. These inkjet actuation rotation counts are stored at the fifth to eighth address positions in the inkjet actuation rotation-count storage memory M26 together with the mark "2 (=disengaging the seal cylinder)".

Thereafter in step S101, a printing-press stop rotation count is calculated by adding a value of 35 (the number of times the combined printing press 100 is rotated before all the print sheets W in the combined printing press 100 are delivered to the delivery unit 140) to the count value of the printing-press rotation-count counter 30, and is stored in the printing-press stop rotation-count storage memory M27. In step S102, a value of 1 is written to the count-value-N storage memory M28.

Thereafter in step S103, the count value of the printing-press rotation-count counter 30 is read and this count value is stored in the printing-press-rotation-count-counter count-value storage memory M12. In step S104, the inkjet actuation rotation count at the N-th address position in the inkjet actuation rotation-count storage memory M26 is read.

Thereafter in step S105, it is determined whether or not the count value of the printing-press rotation-count counter 30 is equal to the inkjet actuation rotation count at the N-th address position in the inkjet actuation rotation-count storage memory M26. If the count value of the printing-press rotation-count counter 30 is different from the inkjet actuation rotation count at the N-th address position in the inkjet actuation rotation-count storage memory M26 (NO), the processing returns to the above-described step S103. On the other hand, if the count value of the printing-press rotation-count counter 30 is equal to the inkjet actuation rotation count at the N-th address position in the inkjet actuation rotation-count storage memory M26 (YES), then in step S106, the mark ("1", "2",or "3")at the N-th address position in the inkjet actuation rotation-count storage memory M26 is read.

In step S107 after step S106, a mark ("1", "2", or "3") ejection command is outputted to the inkjet device 147. As a result, a mark reflecting the printing condition is printed on the marginal region of the printing sheet W based on the contents set in the above-described steps S98, S99, S100.

Thereafter in step S108, a value of 1 is added to the count value N and the count-value-N storage memory M28 is overwritten with it. In step S109, it is determined whether or not the count value N is 9. If the count value N is not 9 (NO), the printing of marks by the inkjet device 147 has not yet been finished, and thus the processing returns to the above-described step S103. On the other hand, if the count value N is 9 (YES), the printing of marks by the inkjet device 147 has been finished, and thus in step S110, the count value of the printing-press rotation-count counter 30 is read and this count value is stored in the printing-press-rotation-count-counter count-value storage memory M12. In step S111, the printing-press stop rotation count in the printing-press stop rotation-count storage memory M27 is read.

Thereafter in step S112, it is determined whether or not the count value of the printing-press rotation-count counter 30 is the printing-press stop rotation count. If the count value of the printing-press rotation-count counter 30 is different from the printing-press stop rotation count (NO), the processing returns to the above-described step S110. On the other hand, if the count value of the printing-press rotation-count counter 30 is equal to the printing-press stop rotation count (YES), then in step S113, a stop command is outputted to the drive-motor driver 33 to stop the combined printing press 100. The processing then returns to the above-described step S1 and waits until the printing start switch 26 is turned on.

[Processing in Case where Trouble Occurs in Second-Number Printing]

Also, if a trouble occurs in the second-number printing due to some reason, an NG signal is outputted from the second-number inspecting device 50C. Thus, the processing proceeds from the above-described step S130 to step S131, in which an emergency disengagement command for the second-number printing that is based on the emergency cylinder engagement-disengagement shift curve illustrated in part B of FIG. 11 is outputted to the second-number-cylinder throw-on and throw-off device 39, and also a sheet-feed stop command is outputted to the sheet feeder 101 to stop feeding new printing sheet W. As a result, emergency disengagement of the second-number cylinder 118 is performed at the rotational phase of the next notch in the impression cylinder 117 of the second-number printing unit 116, thereby suspending the second-number printing.

In step S132 after step S131, a normal disengagement command is outputted to the engaging-disengaging devices other than the second-number-cylinder throw-on and throw-off device, such as the seal-cylinder throw-on and throw-off device 37, the first-number-cylinder throw-on and throw-off device 38, the other-surface-coating-cylinder throw-on and throw-off device 40, and the one-surface-coating-cylinder throw-on and throw-off device 41. As a result, the seal cylinder 108 and the first-number cylinder 113 are disengaged at the rotational phases of the next (immediately following) notches in the impression cylinders 107, 112 of the printing units 106, 111, so that the seal printing and the second-number printing are suspended, respectively. Also, the other-surface coating cylinder 128 and the one-surface coating cylinder 137 are disengaged after performing respectively the other-surface coating and the one-surface coating on printing sheets W already printed at the second-number printing unit 116 before the printing sheets W printed at the second-number printing unit 116 at the time of occurrence of the trouble in the seal printing.

Thereafter in step S133, the count value of the printing-press rotation-count counter 30 is read and this count value is stored in the printing-press-rotation-count-counter count-value storage memory M12.

Thereafter in step S134, an inkjet actuation rotation count is calculated by adding a value of 14 (the number of times the combined printing press 100 is rotated before the inkjet device 147 is reached by the printing sheet W on which the printing failure has occurred) to the count value of the printing-press rotation-count counter 30. This inkjet actuation rotation count is stored at the first address position in the inkjet actuation rotation-count storage memory M26 together with the mark "3 (=waste paper)".

Thereafter instep S135, inkjet actuation rotation counts are calculated by adding values of 15 to 18 (the numbers of rotations of the combined printing press 100 taken before the inkjet device 147 is reached by the printing sheet W printed at the first-number printing unit at the time of occurrence of the trouble in the second-number printing and the printing sheets W already printed at the first-number printing unit before that printing sheet W but yet to be printed at the second-number printing unit 116) to the count value of the printing-press rotation-count counter 30. These inkjet actuation rotation counts are stored at the second to fifth address positions in the inkjet actuation rotation-count storage memory M26 together with the mark "1 (=disengaging the seal cylinder and the first-number cylinder)".

Thereafter in step S136, inkjet actuation rotation counts are calculated by adding values of 19 to 22 (the numbers of rotations of the combined printing press 100 taken before the inkjet device 147 is reached by the printing sheet W printed at the seal printing unit 106 at the time of occurrence of the trouble in the second-number printing and the printing sheets W already printed at the seal printing unit 106 before that printing sheet W but yet to be printed at the first-number printing unit 111) to the count value of the printing-press rotation-count counter 30. These inkjet actuation rotation counts are stored at the sixth to ninth address positions in the inkjet actuation rotation-count storage memory M26 together with the mark "2 (=disengaging the seal cylinder)".

Thereafter in step S137, a printing-press stop rotation count is calculated by adding a value of 35 (the number of times the combined printing press 100 is rotated before all the print sheets W in the combined printing press 100 are delivered to the delivery unit 140) to the count value of the printing-press rotation-count counter 30. This printing-press stop rotation count is stored in the printing-press stop rotation-count storage memory M27. In step S138, a value of 1 is written to the count-value-N storage memory M28.

Thereafter in step S139, the count value of the printing-press rotation-count counter 30 is read and this count value is stored in the printing-press-rotation-count-counter count-value storage memory M12. In step S140, the inkjet actuation rotation count at the N-th address position in the inkjet actuation rotation-count storage memory M26 is read.

Thereafter in step S141, it is determined whether or not the count value of the printing-press rotation-count counter 30 is equal to the inkjet actuation rotation count at the N-th address position in the inkjet actuation rotation-count storage memory M26. If the count value of the printing-press rotation-count counter 30 is different from the inkjet actuation rotation count at the N-th address position in the inkjet actuation rotation-count storage memory M26 (NO), the processing returns to the above-described step S139. On the other hand, if the count value of the printing-press rotation-count counter 30 is equal to the inkjet actuation rotation count at the N-th address position in the inkjet actuation rotation-count storage memory M26 (YES), then in step S142, the mark at the N-th address position in the inkjet actuation rotation-count storage memory M26 is read.

In step S143 after step S142, a mark ("1", "2", or "3") ejection command is outputted to the inkjet device 147. As a result, a mark reflecting the printing condition is printed on the marginal region of the printing sheet W based on the contents set in the above-described steps S134, S135, S136.

Thereafter in step S144, a value of 1 is added to the count value N and the count-value-N storage memory M28 is overwritten with it. In step S145, it is determined whether or not the count value N is 10. If the count value N is not 10 (NO), the printing of marks by the inkjet device 147 has not yet been finished, and thus the processing returns to the above-described step S139. On the other hand, if the count value N is 10 (YES), the printing of marks by the inkjet device 147 has been finished, and thus in step S146, the count value of the printing-press rotation-count counter 30 is read and this count value is stored in the printing-press-rotation-count-counter count-value storage memory M12. In step S147, the printing-press stop rotation count in the printing-press stop rotation-count storage memory M27 is read.

Thereafter in step S148, it is determined whether or not the count value of the printing-press rotation-count counter 30 is equal to the printing-press stop rotation count. If the count value of the printing-press rotation-count counter 30 is different from the printing-press stop rotation count (NO), the processing returns to the above-described step S146. On the other hand, if the count value of the printing-press rotation-count counter 30 is equal to the printing-press stop rotation count (YES), then in step S149, a stop command is outputted to the drive-motor driver 33 to stop the combined printing press 100. The processing then returns to the above-described step S1 and waits until the printing start switch 26 is turned on.

[Reprinting]

As mentioned above, after the printing is suspended by the processes of step S51 to step S69, step S95 to step S113, or step S131 to step S149, each printing sheet W with the mark "1" or "2" printed on its marginal region is placed on the pile board of the sheet feeder 101, and the printing is resumed.

Then, if the mark is found to be "1" as a result of imaging the printing sheet W with the mark detection camera 146 and identifying the mark in the above-described steps S13 to S15, the processing proceeds from the above-described step S16 to step S17, in which the count value of the printing-press rotation-count counter 30 is read and this count value is stored in the printing-press-rotation-count-counter count-value storage memory M12.

As mentioned above, the seal printing has already been performed on the printing sheet W with the mark "1" printed thereon. Thus, in step S18 after step S17, in order to skip the seal printing for this printing sheet W (in order to disengage the seal cylinder 108 when the printing sheet W reaches the seal cylinder 108), a seal-cylinder disengagement rotation count is calculated by adding a value of 2 (the number of times the combined printing press 100 is rotated before the seal cylinder 108 is reached by the printing sheet W after it is imaged by the mark detection camera 146) to the count value of the printing-press rotation-count counter 30, and this is additionally written to the last part of the seal-cylinder disengagement timing storage memory M20. In step S19, the contents of the seal-cylinder disengagement timing storage memory M20 are sorted in ascending order.

The first-number printing has already been performed on the printing sheet W with the mark "1" printed thereon as well. Thus, thereafter in step S20, in order to skip the first-number printing for this printing sheet W (in order to disengage the first-number cylinder 113 when the printing sheet W reaches the first-number cylinder 113), a first-number-cylinder disengagement rotation count is calculated by adding a value of 6 (the number of times the combined printing press 100 is rotated before the first-number cylinder 113 is reached by the printing sheet W after it is imaged by the mark detection camera 146) to the count value of the printing-press rotation-count counter 30, and is additionally written to the last part of the first-number-cylinder disengagement timing storage memory M21. In step S21, the contents of the first-number-cylinder disengagement timing storage memory M21 are sorted in ascending order. The processing then proceeds to the above-described step S26.

On the other hand, if the mark is found to be "2" as a result of imaging the printing sheet W with the mark detection camera 146 and identifying the mark in the above-described steps S13 to S15, the processing proceeds from the above-described step S22 to step S23, in which the count value of the printing-press rotation-count counter 30 is read and this count value is stored in the printing-press-rotation-count-counter count-value storage memory M12.

As mentioned above, the seal printing has already been performed on the printing sheet W with the mark "2" printed thereon. Thus, in step S24 after step S23, as in the above-described step S17, a seal-cylinder disengagement rotation count is calculated by adding a value of 2 to the count value of the printing-press rotation-count counter 30, and this is additionally written to the last part of the seal-cylinder disengagement timing storage memory M20. In step S25, the contents of the seal-cylinder disengagement timing storage memory M20 are sorted in ascending order. The processing then proceeds to the above-described step S26.

Then, if the count value of the printing-press rotation-count counter 30 is the smallest seal-cylinder disengagement rotation count in the above-described step S35, the processing proceeds to step S36, in which it is determined whether or not the output of the seal-cylinder engaged-state detector 42 is on, that is, whether or not the seal cylinder 108 is in an engaged state.

Then, if the output of the seal-cylinder engaged-state detector 42 is off in step S36 (NO), the processing proceeds to the above-described step S42. On the other hand, if the output of the seal-cylinder engaged-state detector 42 is on (YES), then in step S37, a disengagement signal is outputted to the seal-cylinder throw-on and throw-off device 37 to separate the seal cylinder 108 from the impression cylinder 107. As a result, the printing sheet W with the mark "1" or "2" printed on its marginal region, on which the seal printing has already been performed, is transported through the seal printing unit 106 with the seal cylinder 108 disengaged.

In step S38 after step S37, the smallest seal-cylinder disengagement rotation count at the first address position in the seal-cylinder disengagement timing storage memory M20 is deleted. In step S39, each seal-cylinder disengagement rotation count in the seal-cylinder disengagement timing storage memory M20 is rewritten to the next smaller address position. The processing then proceeds to the above-described step S42.

Further, if the count value of the printing-press rotation-count counter 30 is the smallest first-number-cylinder disengagement rotation count in the above-described step S79, then in step S80, it is determined whether or not the output of the first-number-cylinder engaged-state detector 44 is on, that is, whether or not the first-number cylinder 113 is in an engaged state.

If the output of the first-number-cylinder engaged-state detector 44 is off in step S80 (NO), the processing proceeds to the above-described step S86. On the other hand, if the output of the first-number-cylinder engaged-state detector 44 is on (YES), then in step S81, a disengagement signal is outputted to the first-number-cylinder throw-on and throw-off device 38 to separate the first-number cylinder 113 from the impression cylinder 112. As a result, the printing sheet W with the mark "1" printed on its marginal region, on which the first-number printing has already been performed, is transported through the first-number printing unit 111 with the first-number cylinder 113 disengaged.

In step S82 after step S81, the smallest first-number-cylinder disengagement rotation count at the first address position in the first-number-cylinder disengagement timing storage memory M21 is deleted. In step S83, each first-number-cylinder disengagement rotation count in the first-number-cylinder disengagement timing storage memory M21 is rewritten to the next smaller address position. The processing then proceeds to the above-described step S86.

The printing-press control device 10 controls the combined printing press 100 through the above-described operations.

Figure 10:
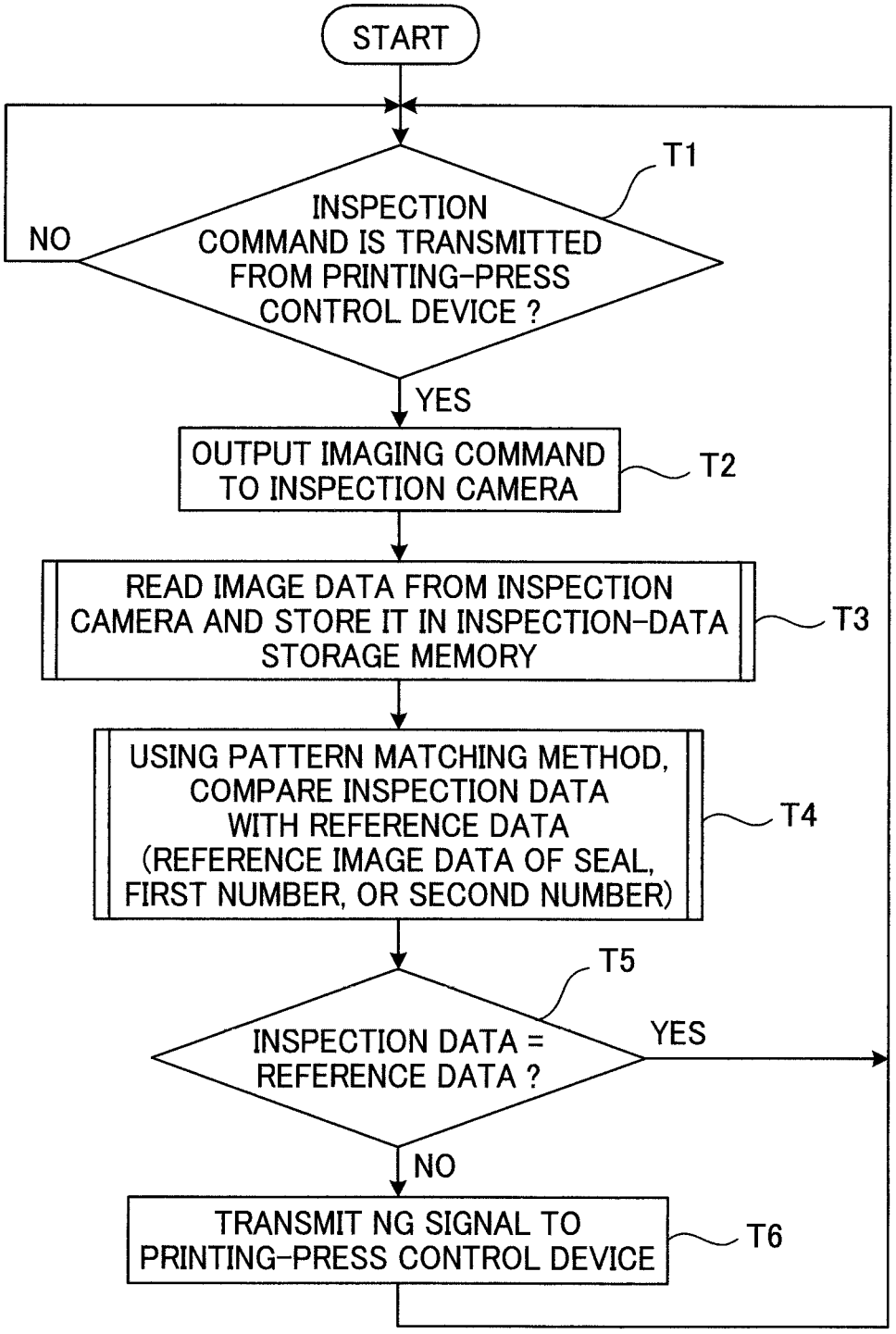
FIG. 10 is a flowchart illustrating the operation of each inspecting device according to the embodiment of the present invention.

Meanwhile, each inspecting device 50 (seal inspecting device 50A, first-number inspecting device 50B, second-number inspecting device 50C) operates for the above-described printing-press control device 10 by following an operation procedure illustrated in FIG. 10.

Specifically, in each inspecting device 50, in step T1, it is determined whether or not an inspection command is transmitted from the printing-press control device 10 by the process of the above-described step S49, S93, or S129. If an inspection command is not transmitted from the printing-press control device 10 (NO), the process of step T1 is iterated. On the other hand, if an inspection command is transmitted from the printing-press control device 10 (YES), then in step T2, an imaging command is outputted to the inspection camera 124 (seal inspection camera 124A, first-number inspection camera 124B, or second-number inspection camera 124C).

In step T3 after step T2, the image data is read from the inspection camera 124 and this image data is stored as inspection data in the inspection-data storage memory M51. In step T4, using a pattern matching method, the inspection data is compared with the reference data (the reference image data of the seal, the first number, or the second number) stored in the reference-data (the reference image data of the seal, the first number, or the second number) storage memory M52.

Note that for the specific processes of step T3 and step T4, known methods may be used, and detailed description thereof will be omitted here.

Thereafter in step T5, it is determined whether or not the inspection data is identical to the reference data. If the inspection data is identical to the reference data (YES), the printing has been done well, and thus the processing returns to the above-described step T1. On the other hand, if the inspection data is different from the reference data (NO), a trouble has occurred in the printing, and thus an NG signal is transmitted to the printing-press control device 10 in step T6. The processing then returns to the above-described step T1.

Each inspecting device 50 performs a printing condition inspection through the above-described operations.

As described above, in this embodiment, the seal printing and the first- and second-number printing are each implemented on a unit basis. The seal printing unit 106, the first-number printing unit 111, and the second-number printing unit 116 are each coupled to another by a single transport cylinder (transfer cylinder) 110, 115. The seal and the numbers printed at the printing units 106, 111, 116 are inspected immediately after the printing with the inspection cameras 124A to 124C, which are provided in such a way as to face the outer peripheral surfaces of the impression cylinders 107, 112, 117 downstream of the positions of contact (printing points) between the impression cylinders 107, 112, 117 and the cylinders 108, 113, 118 in the printing units 106, 111, 116 in the direction of rotation of the impression cylinders 107, 112, 117, respectively. In this way, a printing trouble can be found immediately.

Also, if a trouble occurs in the seal printing, the first-number printing, or the second-number printing, the seal cylinder 108, the first-number cylinder 113, or the second-number cylinder 118 is disengaged by controlling the seal-cylinder throw-on and throw-off device 37, the first-number-cylinder throw-on and throw-off device 38, or the second-number-cylinder throw-on and throw-off device 39 based on the emergency cylinder engagement-disengagement shift curve illustrated in part B of FIG. 11, which is different from the normal cylinder engagement-disengagement shift curve illustrated in part A of FIG. 11. This ensures disengagement at the immediately following notch in the impression cylinder 107, 112, 117 immediately after the occurrence of the trouble.

Further, the cylinders 108, 113, 118 are disengaged when the cylinders 108, 113, 118 face the immediately following notches in the impression cylinders 107, 112, 117, respectively, immediately after the occurrence of a trouble on a printing sheet W, so that the printing of the next sheets is temporarily stopped. The printing necessary for these printing sheets W are performed later. In this way, the printing sheet W on which the printing failure has occurred can be the only wasted paper.

In sum, the inkjet device 147 gives the mark "1" on the marginal regions on the printing sheet W printed at the first-number printing unit 111 at the time of occurrence of a trouble, for example, in the seal printing and the printing sheets W already printed at the first-number printing unit 111 before that printing sheet W but yet to be printed at the second-number printing unit 116. When the printing is resumed, this mark "1" is detected with the mark detection camera 146, so that the printing-press control device 10 continues to perform the second-number printing and the coating on the printing sheets W with the mark "1" printed thereon. Also, the inkjet device 147 gives the mark "2" on the marginal regions on the printing sheets W already printed at the seal printing unit 106 before the printing sheet W with the printing failure, printed at the seal printing unit 106 at the time of occurrence of the above trouble, but yet to be printed at the first-number printing unit 111. When the printing is resumed, this mark "2" is detected with the mark detection camera 146, so that the printing-press control device 10 continues to perform the first- and second-number printing and the coating on the printing sheets W with the mark "2" printed thereon. In this way, these printing sheets W can be regarded as good sheets.

Also, the inkjet device 147 gives the mark "1" on the marginal regions on the printing sheets W already printed at the first-number printing unit 111 before the printing sheet W with the printing failure, printed at the first-number printing unit 111 at the time of occurrence of a trouble, for example, in the first-number printing, but yet to be printed at the second-number printing unit 116. When the printing is resumed, this mark "1" is detected with the mark detection camera 146, so that the printing-press control device 10 continues to perform the second-number printing and the coating on the printing sheets W with the mark "1" printed thereon. Also, the inkjet device 147 gives the mark "2" on the marginal regions on the printing sheet W printed at the seal printing unit 106 at the time of occurrence of the above trouble and the printing sheets W already printed at the seal printing unit 106 before that printing sheet W but yet to be printed at the first-number printing unit 111. When the printing is resumed, this mark "2" is detected with the mark detection camera 146, so that the printing-press control device 10 continues to perform the first- and second-number printing and the coating on the printing sheets W with the mark "2" printed thereon. In this way, these printing sheets W can be regarded as good sheets.

Also, the inkjet device 147 gives the mark "1" on the marginal regions on the printing sheet W printed at the first-number printing unit 111 at the time of occurrence of a trouble, for example, in the second-number printing and the printing sheets W already printed at the first-number printing unit 111 before that printing sheet W but yet to be printed at the second-number printing unit 116. When the printing is resumed, this mark "1" is detected with the mark detection camera 146, so that the printing-press control device 10 continues to perform the second-number printing and the coating on the printing sheets W with the mark "1" printed thereon. Also, the inkjet device 147 gives the mark "2" on the marginal regions on the printing sheet W printed at the seal printing unit 106 at the time of occurrence of the above trouble and the printing sheets W already printed at the seal printing unit 106 before that printing sheet W but yet to be printed at the first-number printing unit 111. When the printing is resumed, this mark "2" is detected with the mark detection camera 146, so that the printing-press control device 10 continues to perform the first- and second-number printing and the coating on the printing sheets W with the mark "2" printed thereon. In this way, these printing sheets W can be regarded as good sheets.

Further, if the printing is done up to the first-number printing and stopped, the engaging-disengaging devices 37, 38, 39 would have to be set up to skip the seal printing and the first-number printing and perform only the second-number printing in order to perform the rest of the printing to make a complete printed product. Likewise, if the printing is done up to the seal printing and stopped, the engaging-disengaging devices 37, 38, 39 would have to be set up to skip the seal printing and perform only the first- and second-number printing. In this embodiment, however, the inkjet device 147 is provided at a position downstream of the contacting portion between the impression cylinder 136 of the one-surface coating unit 135 and the delivery cylinder 141 of the delivery unit 140 in the sheet transport direction and facing the delivery cylinder 141. A mark reflecting the printing condition is printed on the marginal region on the printing sheet W as needed. In the reprinting, the mark printed on the printing sheet W transported on the feeder board 102 is imaged by the mark detection camera 146 to identify the printed mark. Then, the engaged/disengaged states of given cylinders (specifically, the seal cylinder 108 and the first-number cylinder 113) at the respective moments of printing that printing sheet W are controlled according to that mark. This ensures that only the rest of the printing is performed automatically on the printing sheet W. In this way, each time a trouble occurs in printing, the operator does not need to check up to which printing the printing press has performed, manually set up the engagement/disengagement of the engaging-disengaging devices 37, 38, 39 according to that check, and so on. Hence, it is possible to reduce the burden on the operator and also to improve the operation rate.

Thus, according to this embodiment, the wasted paper can be only one printing sheet W. Therefore, the amount of wasted paper produced can be minimized, and the waste of expensive printing sheets W, which are used for securities and the like, can be greatly reduced. Moreover, a printing sheet W on which only the seal printing or the seal printing and the first-number printing have been performed can be made into a complete printed product by performing the rest of the printing automatically. Therefore, the burden on the operator can be reduced as well.

INDUSTRIAL APPLICABILITY

A numbering and imprinting machine according to the present invention is capable of minimizing the amount of wasted paper produced, and is therefore significantly beneficially applicable to the printing industry and the like.

EXPLANATION OF REFERENCE NUMERALS

W print sheet
10 printing-press control device
11, 51 CPU
12, 52 ROM
13, 53 RAM
14 to 24, 54 to 55 input-output device
25, 56 interface
26 printing start switch
27 input device
28 indicator
29 output device
30 printing-press rotation-count counter
31 printing-press initial-position detector
32 D-A converter
33 drive-motor driver
34 drive motor
35 drive-motor rotary encoder
36 printing-press rotational-phase detection counter
37 seal-cylinder throw-on and throw-off device
38 first-number-cylinder throw-on and throw-off device
39 second-number-cylinder throw-on and throw-off device
40 other-surface-coating-cylinder throw-on and throw-off device
41 one-surface-coating-cylinder throw-on and throw-off device
42 seal-cylinder engaged-state detector
43 seal-cylinder disengaged-state detector
44 first-number-cylinder engaged-state detector
45 first-number-cylinder disengaged-state detector
46 second-number-cylinder engaged-state detector
47 second-number-cylinder disengaged-state detector
50 each inspecting device
50A seal inspecting device
50B first-number inspecting device
50C second-number inspecting device
100 combined printing press
101 sheet feeder
102 feeder board
103 swing arm shaft pregripper
104 transfer cylinder
105 transfer cylinder
106 seal printing unit
107 impression cylinder
108 seal cylinder
109 inking device
110 transport cylinder
111 first-number printing unit
112 impression cylinder
113 first-number cylinder
114 inking device
115 transport cylinder
116 second-number printing unit
117 impression cylinder
118 second-number cylinder
119 inking device
120 transport cylinder
121 first drying unit
122 transport cylinder
123 drying lamp
124A seal inspection camera
124B first-number inspection camera
124C second-number inspection camera
125A to 125C lighting device
126 other-surface coating unit
127 impression cylinder
128 other-surface coating cylinder
129 anilox roller
130 chamber coater
131 transport cylinder
132 second drying unit
133 transport cylinder
134 drying lamp
135 one-surface coating unit
136 impression cylinder
137 one-surface coating cylinder
138 anilox roller
139 chamber coater
140 delivery unit
141 delivery cylinder
142 transport chain
143*a* to 143*c* pile board
144 suction guide
145 drying lamp
146 mark detection camera
147 inkjet device
M11 to M40, M51 to M52 memory

The invention claimed is:

1. A numbering and imprinting machine comprising:

a first-number printing device including a first-number impression cylinder that holds and transports a sheet, a first-number cylinder that is arranged to be movable to come into contact with and separate from the first-number impression cylinder and performs first-number printing on a sheet held on the first-number impression cylinder, and a first ink feeding device for feeding ink to the first-number cylinder;

a second-number printing device including a second-number impression cylinder that is arranged downstream of the first-number printing device in a sheet transport direction and holds and transports a sheet from the first-number printing device, a second-number cylinder that is arranged to be movable to come into contact with and separate from the second-number impression cylinder and performs second-number printing on a sheet held on the second-number impression cylinder, and a second ink feeding device for feeding ink to the second-number cylinder;

a first-number-cylinder contacting-separating-movement device for causing the first-number cylinder to move to come into contact with and separate from the first-number impression cylinder;

a second-number-cylinder contacting-separating-movement device for causing the second-number cylinder to move to come into contact with and separate from the second-number impression cylinder;

a first-number imaging device that is arranged downstream of a position of contact between the first-number impression cylinder and the first-number cylinder in a direction of rotation of the first-number impression cylinder, for imaging a first number printed on a sheet held on the first-number impression cylinder;

a second-number imaging device that is arranged downstream of a position of contact between the second-number impression cylinder and the second-number cylinder in a direction of rotation of the second-number impression cylinder, for imaging a second number printed on a sheet held on the second-number impression cylinder;

a number inspecting device for determining whether or not the first number and the second number printed on a sheet are satisfactory based on image signals from the first-number imaging device and the second-number imaging device; and a controlling device for controlling the first-number-cylinder contacting-separating-movement device and the second-number-cylinder contacting-separating-movement device based on a dissatisfactory signal from the number inspecting device to cause the first-number cylinder and the second-number cylinder to make separating movements.

2. The numbering and imprinting machine according to claim 1, further comprising:

a seal printing device including a seal impression cylinder that is arranged upstream of the first-number printing device in the sheet transport direction, holds a sheet, and transports the sheet toward the first-number printing device, a seal cylinder that is arranged to be movable to come into contact with and separate from the seal impression cylinder and performs seal printing on a sheet held on the seal impression cylinder, and a third ink feeding device for feeding ink to the seal cylinder;

a seal-cylinder contacting-separating-movement device for causing the seal cylinder to move to come into contact with and separate from the seal impression cylinder;

a seal imaging device that is arranged downstream of a position of contact between the seal impression cylinder and the seal cylinder in a direction of rotation of the seal impression cylinder, for imaging a seal printed on a sheet held on the seal impression cylinder; and a seal inspecting device for determining whether or not the seal printed on a sheet is satisfactory based on an image signal from the seal imaging device, wherein the controlling device controls the seal-cylinder contacting-separating-movement device, the first-number-cylinder contacting-separating-movement device, and the second-number-cylinder contacting-separating-movement device based on a dissatisfactory signal from the seal inspecting device or the number inspecting device to cause the seal cylinder, the first-number cylinder, and the second-number cylinder to make separating movements.

3. The numbering and imprinting machine according to claim 1, wherein the controlling device outputs an emergency separating movement signal for causing the first number cylinder and the second-number cylinder to make an emergency separating movement to the first-number-cylinder contacting-separating-movement device and the second-number-cylinder contacting-separating-movement device based on the dissatisfactory signal from the number inspecting device.

4. The numbering and imprinting machine according to claim 3, wherein the controlling device controls the first-number cylinder contacting-separating-movement device and the second-number-cylinder contacting-separating-movement device based on the emergency separating movement signal to cause the first-number cylinder and the second-number cylinder to make an emergency separating movement at an emergency cylinder movement timing different from a normal cylinder movement timing used when a printing operation is ended.

5. The numbering and imprinting machine according to claim 2, further comprising:

an inkjet device provided at a delivery unit; and a mark imaging device provided at a sheet feeder, wherein the controlling device controls the inkjet device based on the dissatisfactory signal from the seal inspecting device or the number inspecting device to print on a sheet a mark that varies depending on a printing condition, controls the mark imaging device to image the mark printed on the sheet by the inkjet device, and controls the seal-cylinder contacting-separating-movement device, the first-number-cylinder contacting-separating-movement device and the second-number-cylinder contacting-separating-movement device according to a mark identified based on an image signal from the mark imaging device.

6. The numbering and imprinting machine according to claim 2, wherein the controlling device outputs an emergency separating movement signal for causing the seal cylinder, the first-number cylinder, and the second-number cylinder to make an emergency separating movement to the seal-cylinder contacting-separating-movement device, the first-number-cylinder contacting-separating movement device, and the second-number-cylinder contacting-separating-movement device based on the dissatisfactory signal from the seal inspecting device or the number inspecting device.

* * * * *